US011701853B1

(12) United States Patent
Busnardo

(10) Patent No.: US 11,701,853 B1
(45) Date of Patent: Jul. 18, 2023

(54) ROSIN PRESS WITH INTERLOCKING FRAME

(71) Applicant: PMG COS AZ, LLC, Lake Havasu, AZ (US)

(72) Inventor: Ryan Burl Busnardo, Corona, CA (US)

(73) Assignee: PMG COS AZ, LLC, Lake Havasu, AZ (US)

( * ) Notice: Subject to any disclaimer, the term of this patent is extended or adjusted under 35 U.S.C. 154(b) by 44 days.

(21) Appl. No.: 16/905,679

(22) Filed: Jun. 18, 2020

Related U.S. Application Data

(60) Provisional application No. 62/864,758, filed on Jun. 21, 2019.

(51) Int. Cl.

| | |
|---|---|
| ***B30B 9/04*** | (2006.01) |
| ***B30B 15/34*** | (2006.01) |
| ***B30B 15/04*** | (2006.01) |
| ***B30B 15/14*** | (2006.01) |
| ***B30B 15/06*** | (2006.01) |

(52) U.S. Cl.
CPC ..... *B30B 9/04* (2013.01); *B30B 9/047* (2013.01); *B30B 15/04* (2013.01); *B30B 15/064* (2013.01); *B30B 15/148* (2013.01); *B30B 15/34* (2013.01)

(58) Field of Classification Search
CPC ..... B30B 9/04; B30B 9/047; B30B 15/064; B30B 15/148; B30B 15/34; B30B 15/04; B30B 15/042; B30B 15/044; B30B 15/047; A47J 19/02
USPC ..... 220/4.33, 4.34
See application file for complete search history.

(56) References Cited

U.S. PATENT DOCUMENTS 2,745,338 A * 5/1956 Wissman ..... B30B 1/26 100/282
2,919,045 A * 12/1959 Waugh ..... B65D 19/12 220/4.34
3,591,212 A * 7/1971 Rhyne ..... B27M 1/02 403/231
3,931,728 A 1/1976 Trolle
(Continued)

FOREIGN PATENT DOCUMENTS

CN 104354316 A 2/2015
CN 108263019 A 7/2018
(Continued)

OTHER PUBLICATIONS

Nugsmasher, "Nugsmasher Operating Instructions," Oct. 2018, in 3 pages.

(Continued)

*Primary Examiner* — Jimmy T Nguyen
(74) *Attorney, Agent, or Firm* — Knobbe, Martens, Olson & Bear, LLP

(57) ABSTRACT

Various rosin press assemblies and methods are described. The rosin press assemblies can include a frame, press plates, a user interface, a press system, and a control unit. The frame can include a plurality of support elements, such as plates. Each plate within the frame can have tabs formed on the ends and edges of the plates and can have slots formed in the plates. The tabs from one plate can interlock with tabs or slots from other plates to form an interlocking frame. The interlocking frame can increase rigidity of the frame to prevent the frame from flexing during operation of the rosin press.

16 Claims, 16 Drawing Sheets

(56) References Cited

U.S. PATENT DOCUMENTS

| | | | | |
|---|---|---|---|---|
| 4,206,699 | A | 6/1980 | Hemmelgarn | |
| 4,317,359 | A * | 3/1982 | Georg | B30B 1/22 72/454 |
| 4,442,767 | A * | 4/1984 | Johnson | A47J 19/02 100/116 |
| 4,475,278 | A * | 10/1984 | Schockman | B30B 1/26 29/469 |
| 5,357,728 | A * | 10/1994 | Duncanson | B29C 65/56 52/592.4 |
| 6,202,847 | B1 * | 3/2001 | Hardy | B65D 21/0213 206/509 |
| 8,381,455 | B2 * | 2/2013 | Schooley | E04H 1/1205 52/79.5 |
| D857,065 | S * | 8/2019 | Rebholz | D15/123 |
| 2019/0263079 | A1 * | 8/2019 | Britton | B30B 15/34 |
| 2020/0147915 | A1 * | 5/2020 | Mayer | B30B 15/34 |
| 2022/0016863 | A1 | 1/2022 | Busnardo et al. | |

FOREIGN PATENT DOCUMENTS

| | | | |
|---|---|---|---|
| EP | 0256570 | A1 | 2/1988 |
| GB | 628368 | A | 8/1949 |

OTHER PUBLICATIONS

Nugsmasher, "Nugsmasher Touch Owner's Manual,"© 2019, in 12 pages.

The Wayback Machine, "Nugsmasher Rosin Press," https://web.archive.org/web/20180602174356/https://nugsmasher.com/, archived Jun. 2, 2018, retrieved Nov. 17, 2021, in 13 pages.

Tuopuke, "Mini Rosin Press 8Ton Pressure Hydraulic 6x12cm plates HP02,"© 2020, in 9 pages.

* cited by examiner

ROSIN PRESS WITH INTERLOCKING FRAME

CROSS-REFERENCE

This application claims priority to U.S. Provisional Patent Application No. 62/864,758, filed Jun. 21, 2019, the contents of which are incorporated by reference herein in their entirety and for all purposes.

BACKGROUND

Field

The present disclosure relates generally to presses, such as rosin presses and related methods.

Description of Certain Related Art

Rosin is a solid form of resin obtained from certain plants. Rosin can be produced with an extraction process that uses a combination of heat and pressure. This process can extract (e.g., vaporize, squeeze, etc.) volatile liquid terpene components, which can be collected as the rosin. The result can be semi-transparent and can vary in color from nearly clear to yellow to black.

Various organic materials can be used to create rosin. For example, rosin can be produced from pine or other conifers. Another material that can be used to produce rosin is *cannabis*. *Cannabis* can have important uses across several different fields, such as the medical, culinary, and recreational fields. The *cannabis* rosin can be used in a *cannabis* product, such as an edible, smokable, or otherwise usable product.

SUMMARY OF CERTAIN ASPECTS

Rosin presses are presses that can be used to produce rosin. Rosin presses can include a pressing mechanism and heating mechanism, which can operate together to produce the rosin. Rosin presses are advantageous because, for example, they can produce rosin without using solvents, which are inconvenient, messy, and/or can have negative health aspects. Current rosin presses, however, fail to reliably apply pressure and heat, which leads to an inefficient extraction process.

In one embodiment, a rosin press apparatus configured to extract rosin from a plant material is disclosed. The rosin press apparatus can include a frame having a first plate and a second plate, the first and second plates being interdigitated at a corner of the frame. The rosin press apparatus can include a press connected to the frame. The rosin press apparatus can include a first press plate connected to the press. The rosin press apparatus can include a second press plate connected to the frame and oriented above the first press plate. The press can be configured to drive the first press plate towards the second press plate, thereby applying pressure to the plant material positioned between the first and second press plates.

For purposes of this summary, certain aspects, advantages, and novel features of certain disclosed inventions are summarized. It is to be understood that not necessarily all such advantages may be achieved in accordance with any particular embodiment of the invention. Thus, for example, those skilled in the art will recognize that the inventions disclosed herein may be embodied or carried out in a manner that achieves one advantage or group of advantages as taught herein without necessarily achieving other advantages as may be taught or suggested herein. Further, the foregoing is intended to summarize certain disclosed inventions and is not intended to limit the scope of the inventions disclosed herein.

BRIEF DESCRIPTION OF THE DRAWINGS

The drawings show illustrative embodiments, but do not depict all embodiments. Other embodiments may be used in addition to, or instead of, the illustrative embodiments. Details that may be apparent or unnecessary may be omitted for the purpose of saving space or for more effective illustrations. Some embodiments may be practiced with additional components or steps and/or without some or all components or steps provided in the illustrations. When different drawings contain the same numeral, that numeral refers to the same or similar components or steps.

DETAILED DESCRIPTION OF ILLUSTRATIVE EMBODIMENTS

Figure 1:
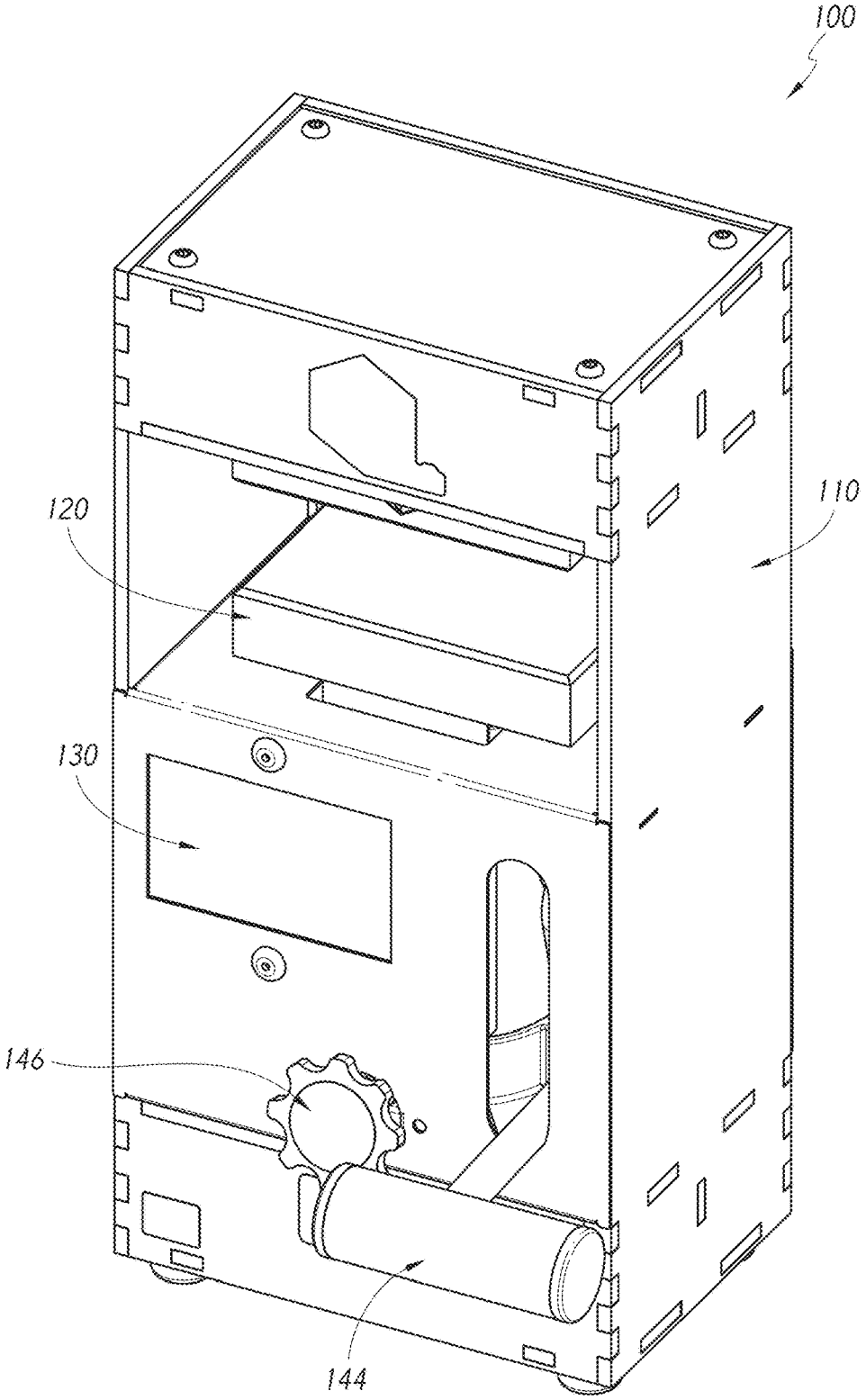
FIG. 1 illustrates a front perspective view of an embodiment of a press assembly.
Figure 2:
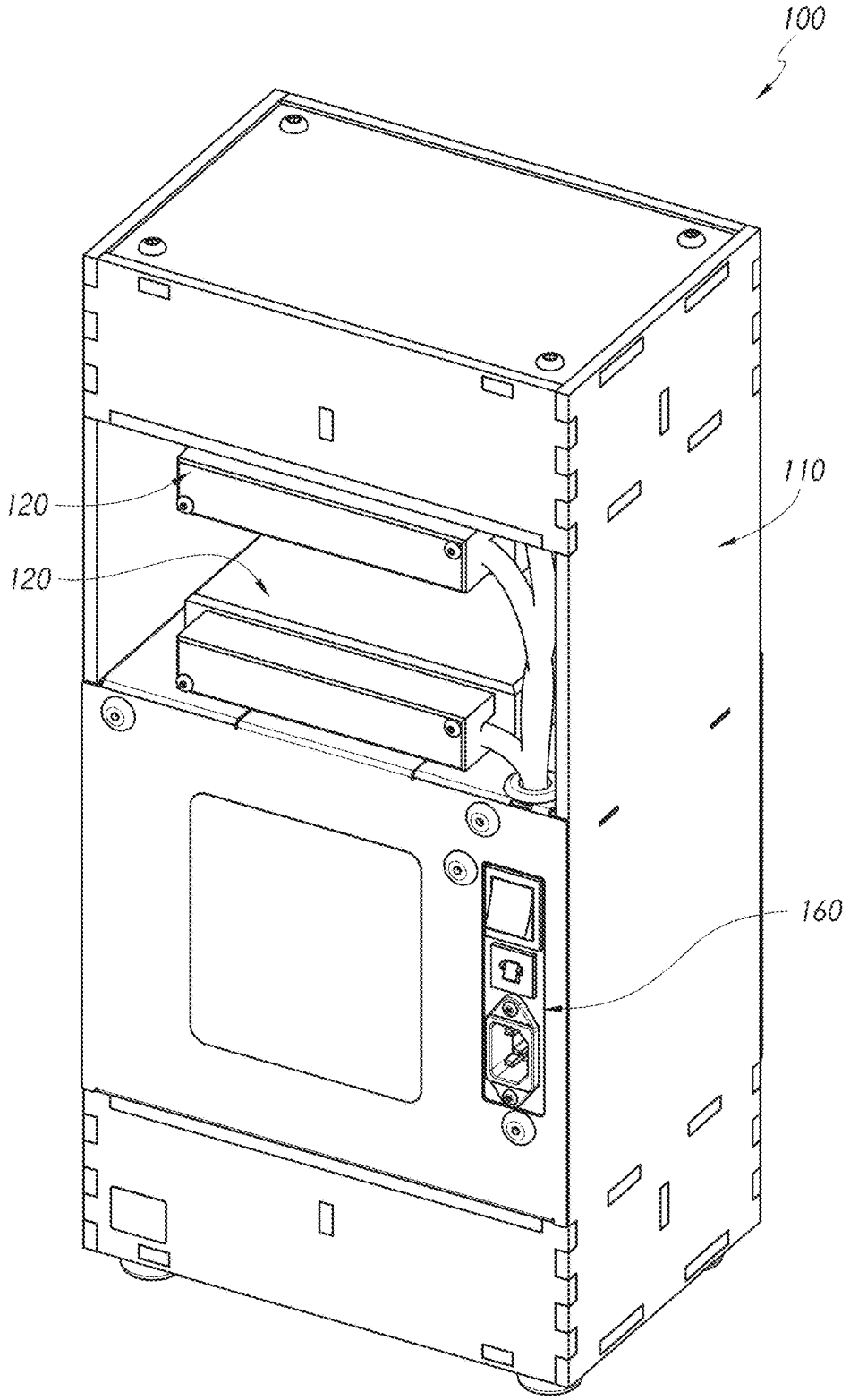
FIG. 2 illustrates a rear perspective view of the press assembly of FIG. 1.

Rosin presses can be used to extract rosin from organic material, such as *cannabis*. Rosin presses work by applying pressure and heat to plant material (e.g. leaves, flowers). Pressure can be applied to the material by pressing the material between two plates. Heat can be applied to the material by heating the plates that press the plant material with a heating element. By applying heat and pressure, rosin can be extracted from the plant material and be easily collected. For purposes of presentation, the following description describes producing rosin from *cannabis*, however the devices and methods described herein can be used to produce rosin from a wide variety of organic material.

To reduce or prevent waste, a rosin press seeks to efficiently extract rosin from the *cannabis* (e.g., by extracting as much rosin as possible or practicable). To enhance such efficient operation, it is beneficial for the rosin press to be capable of applying a precise pressure and temperature to the *cannabis* plant material for a specific period. In particular, it is advantageous for the rosin press to be capable of applying the precise pressure and temperature that results in the most rosin being extracted. Different combinations of pressure and temperature can result in different amounts of rosin extracted from the same variety of *cannabis*, with some combinations resulting in more rosin than other combinations. Thus, if the rosin press applies a suboptimal pressure and temperature combination, the rosin press will be less efficient. By applying a precise pressure and temperature combination, a rosin press can extract more rosin more reliably that other rosin presses that do not apply precise pressure and temperature combinations.

Furthermore, to enhance the amount of rosin output, it can be beneficial for the rosin press to be adjustable to accommodate different pressure and temperature ranges. Not all varieties of *cannabis* require the same pressure and temperature to release the maximum amount of rosin. For example, some varieties of *cannabis* will require higher temperatures and pressures than other varieties to release the maximum amount of rosin. Other factors, such as the freshness of the plant material, the amount of the plant material used, and the surface area of the plant material can also affect the amount of pressure and temperature that needs to be applied to ensure the maximum amount of rosin is released. Thus, it can be advantageous for the rosin press to be adjustable, so the press can accommodate more varieties of *cannabis* and other variables.

Overview

An example of a rosin press assembly is illustrated in FIGS. 1-5 and 9-11. The rosin press assembly 100 can be an efficient and effective rosin press. As illustrated, the rosin press assembly 100 can include a frame 110, a plurality (e.g., two) of press plates 120, a user interface 130, a press system 140, and a control unit 160. As shown, the assembly 100 can include a handle 144 and a release actuator 146.

The frame 110 provides structural support for the rosin press assembly 100. The frame 110 can be made from several pieces connected together, such as interlocking pieces, as is described in more detail below. The pieces can be connected with male and female elements, such as tabs and slots. Certain embodiments will be disclosed below with tabs on certain pieces and slots on other pieces, but this is not to be interpreted as limiting. The present disclosure contemplates and includes implementations in which the tabs and slots are reversed, other male and female connection mechanisms, and non-gendered connection mechanisms.

The press plates 120 can be connected to the frame 110. In some embodiments, one press plate 120 can connect to the frame 110 near the top of the frame 110 and be oriented downwards. A second press plate 120 can be positioned below the first press plate 120 and be oriented upwards to face the first press plate 120. The second press plate 120 can be connected to the press system 140. The press system 140 can adjust the pressure applied by the press plates 120. The press system 140 can move one or both of the press plates 120 together. For example, the second press plate can be moved generally upward toward the first press plate. In some embodiments, the first press plate is held stationary relative to the frame 110. The press plates 120 can be used to press against and apply pressure to plant material. The press plates 120 can contain a heating element. The heating element can heat one or more of the plates, thereby heating the plant material on the plates 120, such as during a pressing operation. The press plates 120 can be made from aluminum or other material that is good at conducting heat.

The user interface 130 can connect to and be supported by a support plate 113. The user interface 130 can allow a user to enter inputs, make adjustments to the rosin press assembly 100, and/or receive data about the rosin press assembly 100. The user interface can comprise, for example, a display, touchscreen, gauge, buttons, switches, etc.

The control unit 160 can include various electronics components of the rosin press assembly 100. For example, the control unit 160 can include a microprocessor configured to control operation of the press 142, heating element, or other features. The control unit 160 can be connected to the frame 110 at the rear of the rosin press assembly 100.

Frame

The frame 110 provides structural support for the rosin press assembly 100. Other components of the rosin press assembly 100 can be connected to and/or secured to the frame 110, such as by a removable connection (e.g., fasteners) or a permanent connection (e.g., welds). For example, the frame 110 can be configured to couple to and/or support the load from the press system 140. The press system 140 can connect to a base plate 115 of the frame 110.

FIGS. 3-5 and 9 illustrate certain features of the frame 110 of the rosin press assembly 100. The frame 110 can include a plurality of support elements. The following discussion describes the support elements as "plates," which is a broad term and can include, for example, sheets, struts, bars, dowels, beams, etc. The plates can be generally planar or non-planar. The plates can be generally straight or can be bent, curved, angled, etc. The plurality of plates can connect, such as by interlocking together. The plates can connect to form a three-dimensional structure, such as the rectangular cuboid structure illustrated. The plurality of plates can be connected together through a detachable connection, such as fasteners, through a permanent connection, such as welding, or a combination of both. Preferably, the plates are made from metal (e.g., steel). Other materials are contemplated as well, such as hard plastic. In some embodiments, the plates can have a thickness of at least about: 4 mm, 6 mm, 8 mm, 10 mm, or otherwise. The plates can be made of an appropriate material, have sufficient thickness, and be otherwise configured to provide rigidity for the press 100.

The frame 110 can include one or more end plates 111. The end plates 111 can be positioned at the top and/or bottom of the frame 110.

The frame 110 can include one or more side plates 112, such as a first and second side plate. The side plates 112 can extend generally vertically along the y-axis or sides of the frame 110.

The frame 110 can include one or more support plates 113. The support plate 113 can extend along the y-axis and/or z-axis of the frame 110.

The frame 110 can include one or more cross plates 114. One or more cross plates 114 can extend generally horizontally along the x-axis and/or along the z-axis of the frame 110.

The frame 110 can include one or more base plates 115. One or more base plates 115 can extend generally horizontally along the x-axis and/or z-axis of the frame.

Figure 4:
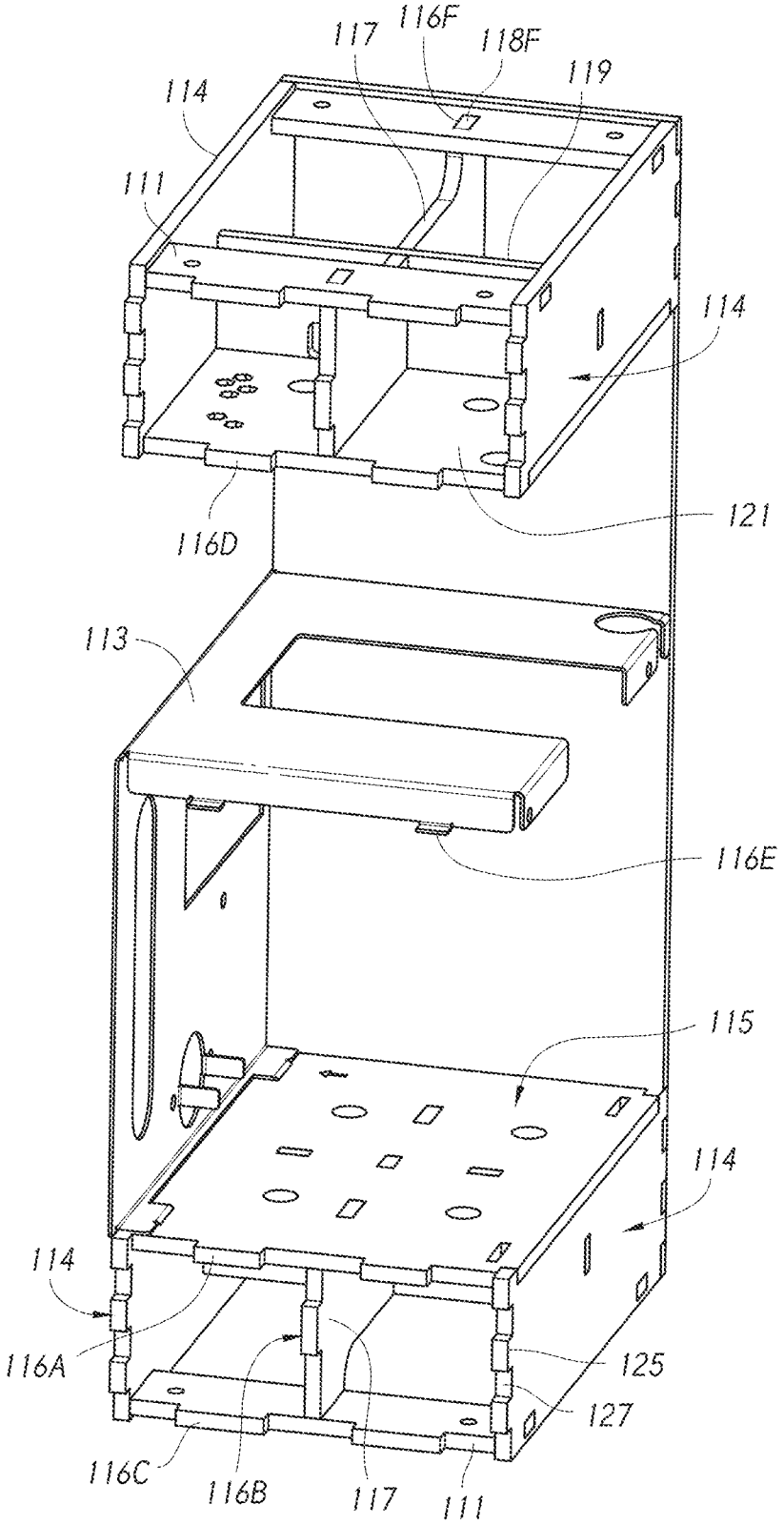
FIG. 4 illustrates a side perspective view of the frame assembly of FIG. 3 with a side plate removed for purposes of presentation.

The frame 110 can include one or more intermediate plates 117. The intermediate plates 117 can extend generally horizontally along the x-axis of the frame 110. As shown in FIG. 4, at least one of the intermediate plates 117 can be positioned between (e.g., about midway between) the cross plates 114 in the z-axis direction.

The frame 110 can include one or more transverse plates 119. The transverse plates 119 can extend generally horizontally along the z-axis of the frame 110. At least one of the transverse plates 119 can be positioned between (e.g., about midway between) the side plates 112 in the x-axis direction.

The frame 110 can include one or more upper plates 121. The upper plate can connect to and/or support one of the press plates 120.

The plates can interconnect, such as with a physical connection that is configured to promote strength and rigidity. In some implementations, each plate 111, 112, 113, 114, 115, 117, 119, and 121 can be connected to one or more of the other plates 111, 112, 113, 114, 115, 117, 119, and 121. The plates (e.g., end plates 111, side plates 112, support plates 113, cross plates 114, and base plates 115) can be interlocked with each other. The plates 111, 112, 113, 114, 115, 117, 119, and 121 can include tabs that engage with corresponding slots in mating plates. For example, the end plates 111, side plates 112, cross plates 114, and base plates 115 can include tabs 116 formed at the ends of the respective plates 111, 112, 113, 114, and 115, or along the edges of the plates 111, 112, 113, 114, and 115. In some embodiments, the tabs and slots engage with a friction fit.

Figure 3:
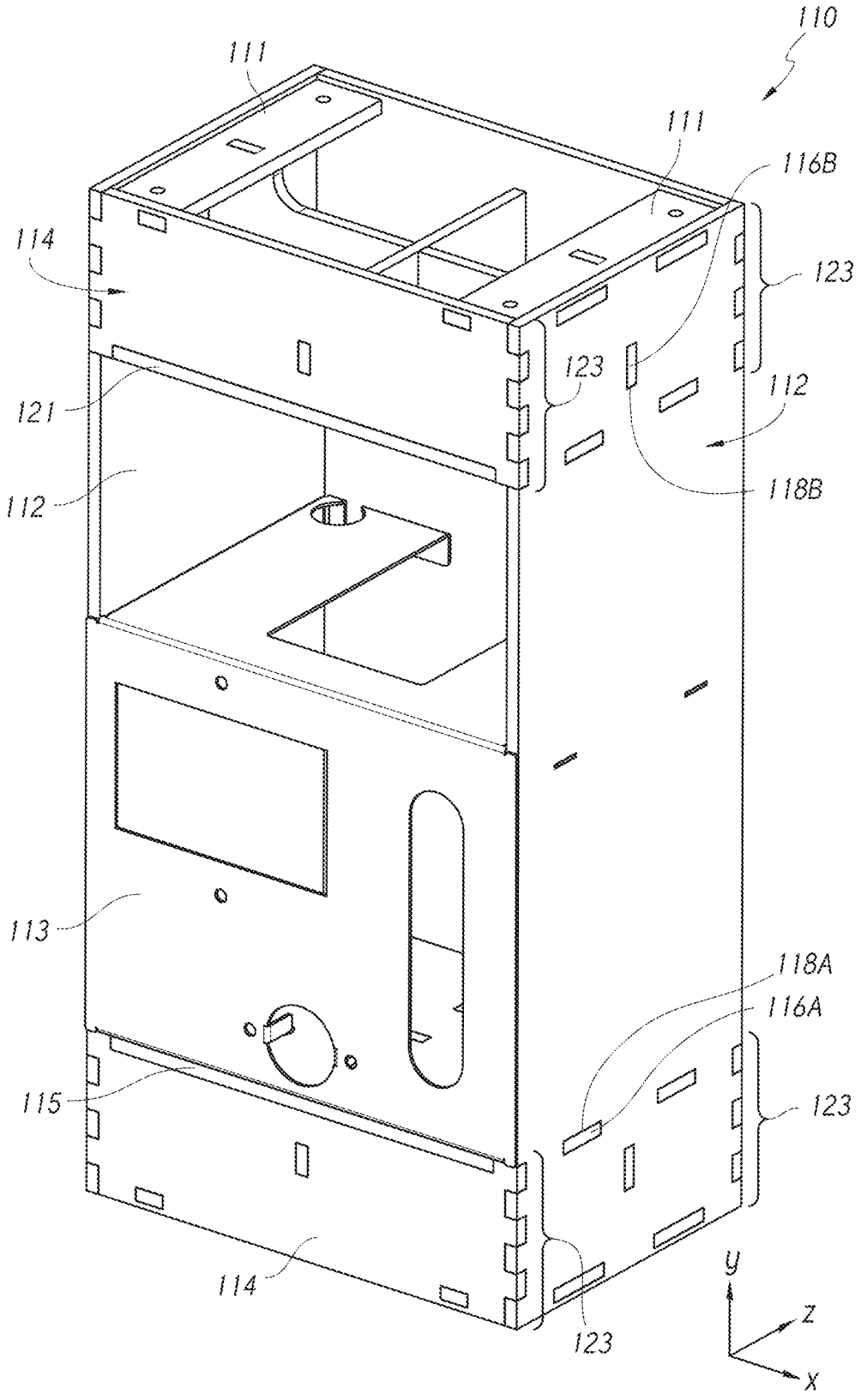
FIG. 3 illustrates a front perspective view of a frame assembly of the press assembly of FIG. 1.

As shown in FIGS. 3 and 4, in some implementations, the plates engage in a castellated region 123. For example, as illustrated in FIG. 3, the frame 110 can have a castellated region 123 at multiple corners, or each corner, of the frame 110. The castellated regions can provide multiple physical interference locations between mating plates, thereby increasing strength and/or rigidity of the frame during operation while also easing assembly during manufacture. The castellated region 123 can include tabs 116 that intermesh and/or interdigitate. The illustrated embodiment includes castellated regions 123 with 6 interdigitated tabs 116. Certain variants have other numbers of interdigitated tabs 116, such as: 2, 3, 4, 5, 7, 8, or more. In some implementations, the castellated regions 123 are on one or more corners of the frame 110. For example, as illustrated, the castellated regions 123 can be on upper and/or lower corners on the front and/or rear of the frame 110. In various embodiments, one or more of the corners comprise two or more of the plates connecting at an angle of at least about: 45°, 60°, 90°, 120°, 180°, or otherwise. In some implementations, the castellated regions 123 span at least the height of the cross plate 114 or intermediate plate 117. In certain implementations, the length of the castellated regions 123 is at least about 50% of the front-to-rear depth of the frame 110, and/or at least about 25% of the side-to-side width of the frame 110, and/or at least about 10% of the top-to-bottom height of the frame 110.

In the castellated region 123, or in other regions, the tabs 116 can form a peak-and-valley like shape at the ends of the plate 111, 112, 113, 114, and 115. The tabs 116 can form a peak 125 and the space between the tabs 116 can form a valley 127. The valley 127 on one plate 111, 112, 113, 114, and 115 can be used to mate with a peak 125 on a second plate 111, 112, 113, 114, and 115 and vice versa. For example, some of the tabs 116 on a side plate 112 can mate with some of the tabs 116 on a cross plate 114 by filling the space between the tabs 116 on the cross plate 114. The tabs 116 from one plate 111, 112, 113, 114, and 115 can fit with the tabs from a second plate 111, 112, 113, 114, and 115. In various embodiments, the tabs 116 from one plate 111, 112, 113, 114, and 115 can mate and hold together without the need for a weld. In some embodiments, a peak 125 from a plate 111, 112, 113, 114, and 115 mates with a valley 127 from a second plate 111, 112, 113, 114, and 115. In other embodiments, two or more peaks 125 from a plate 111, 112, 113, 114, and 115 mates with two or more valleys 127 from a second plate 111, 112, 113, 114, and 115. In various embodiments, any of the plates can have 1, 2, 3, 4, 5, 6, 7, 8, 9, 10 or more tabs 116 which can be used to mate with the same number of tabs 116 from one or more plates 111, 112, 113, 114, and 115. As illustrated, the tabs can be stacked generally vertically (e.g., one above another).

Figure 5:
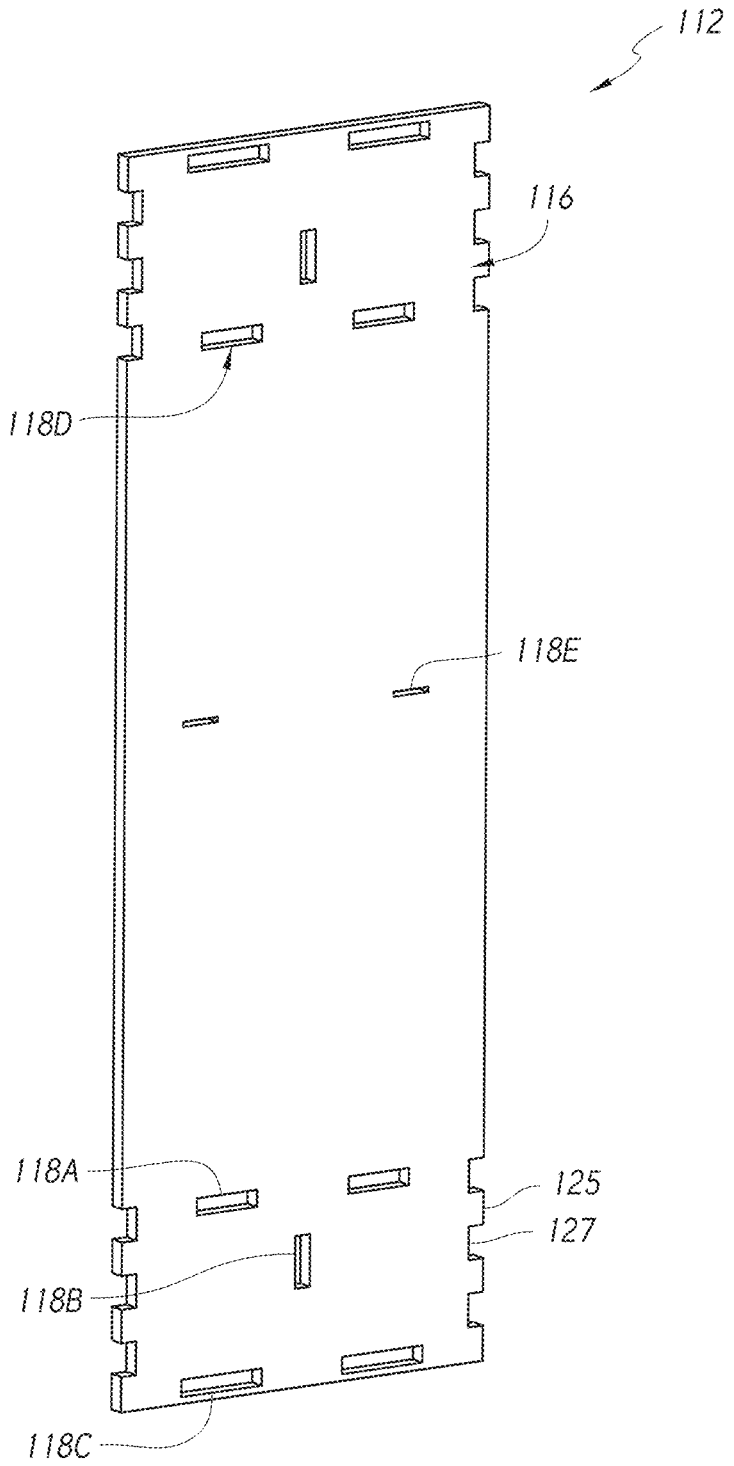
FIG. 5 illustrates a perspective view of a side plate of the frame assembly of FIG. 3.

As also illustrated in FIGS. 3-5, in some embodiments, one or more of the tabs 116 mates with a corresponding one or more slots 118. For example, the slots 118 can be formed between the ends of the plates 111, 112, 113, 114, 115, 117, 119, and 121. The slots 118 can be shaped and sized to tightly fit the tabs 116 of a second plate 111, 112, 113, 114, 115, 117, 119, and 121 and/or can form a friction fit with the tabs 116. The tabs 116 and slots 118 can be of varying sizes and can be oriented in different manners. For example, the tabs 116 and pairing slots 118 can be oriented generally horizontally, while other tabs 116 and pairing slots 118 can be oriented generally vertically.

The combination of interfacing tabs 116 and slots 118 can be used to create an interlocking structure within the frame 110. This interlocking structure can be formed with tabs 116 from multiple plates 111, 112, 113, 114, 115, 117, 119, and 121 interacting with the tabs 116 and slots 118 from other plates 111, 112, 113, 114, 115, 117, 119, and 121. For example, a base plate 115, four cross plates 114, two side plates 112, and two end plates 111 can form an interlocking structure near the top and bottom of the frame 110. The tabs 116 at the ends and edges of the end plates 111, side plates 112, cross plates 114, and base plate 115, can interlock with the tabs 116 and slots 118 of the end plates 111, side plates 112, cross plates 114, and base plate 115 that each plate 111, 112, 114, and 115 is connected to. The interlocking structure can be formed near the top of the frame 110, near the bottom of the frame 110, near the middle of the frame 110, or at multiple points along the frame 110.

In the embodiment of FIGS. 3-5, the base plate 115 has a tab 116A and the side plate 112 has a corresponding slot 118A that receives the tab 116A. As shown, the intermediate plate 117 can include a tab 116B and the side plate 112 can have a corresponding slot 118B that receives the tab 116B. The end plate 111 can have a tab 116C and the side plate 112 can include a corresponding slot 118C that receives the tab 116C. The upper plate 121 can include a tab 116D and the side plate 112 can have a corresponding slot 118D that receives the tab 116C. In some embodiments, the support plate 113 has a tab 116E that mates in a corresponding slot 118E in the side plate 112. In some variants, the intermediate plate 117 connects to the end plate 111, such as with a tab 116F of the intermediate plate 117 that is a received in a corresponding slot 118F in the end plate 111. Any of the plates can include multiple tabs and the mating plate can include the corresponding number of slots. The tabs and slots can be generally horizontal, generally vertical, or otherwise oriented. For example, the tabs 116A, 116C, 116D, and/or 116E (and the corresponding slots) can be generally horizontal. In certain implementations, the tab 116B and corresponding slot is generally vertical. In some embodiments, some or each of the tabs 116 have substantially the same shape, size, height, thickness, and/or other attribute. In certain variants, one or more of the tabs 116 have different shapes, sizes, heights, thicknesses, and/or other attributes. As illustrated, in certain embodiments, the tabs 116 comprise a generally rectangular (e.g., square) shape. Some implementations have tabs 116 with other shapes, such as tapered, trapezoidal, oval, hexagonal, or otherwise.

The interlocking structure of the frame 110 can increase strength, rigidity, and/or efficiency of the rosin press assembly 100. The interlocking structure created in the frame 110 can inhibit or prevent the frame 110 from flexing when under the load applied by the press system, which can be hundreds or thousands of pounds or more. Flexing in the frame 110 can inhibit or prevent the press system 140 from applying an even pressure across the surface of the press plates 120. This uneven pressure could lead to a suboptimal and/or a different pressure being applied to the *cannabis*, and thus lead to an inefficient or undesired result. The interlocking structure of the frame 110 can avoid this flexing. The interlocking structure increases the rigidity of the frame 110, which allows the frame 110 to maintain its shape when a load is being applied to the frame 110. This increase in rigidity can cause the frame 110 to handle the load applied to the frame 110 from the press system 140 without flexing. Accordingly, this increased rigidity formed by the interlocking structure can allow the press system 140 to apply an even pressure.

Figure 6:
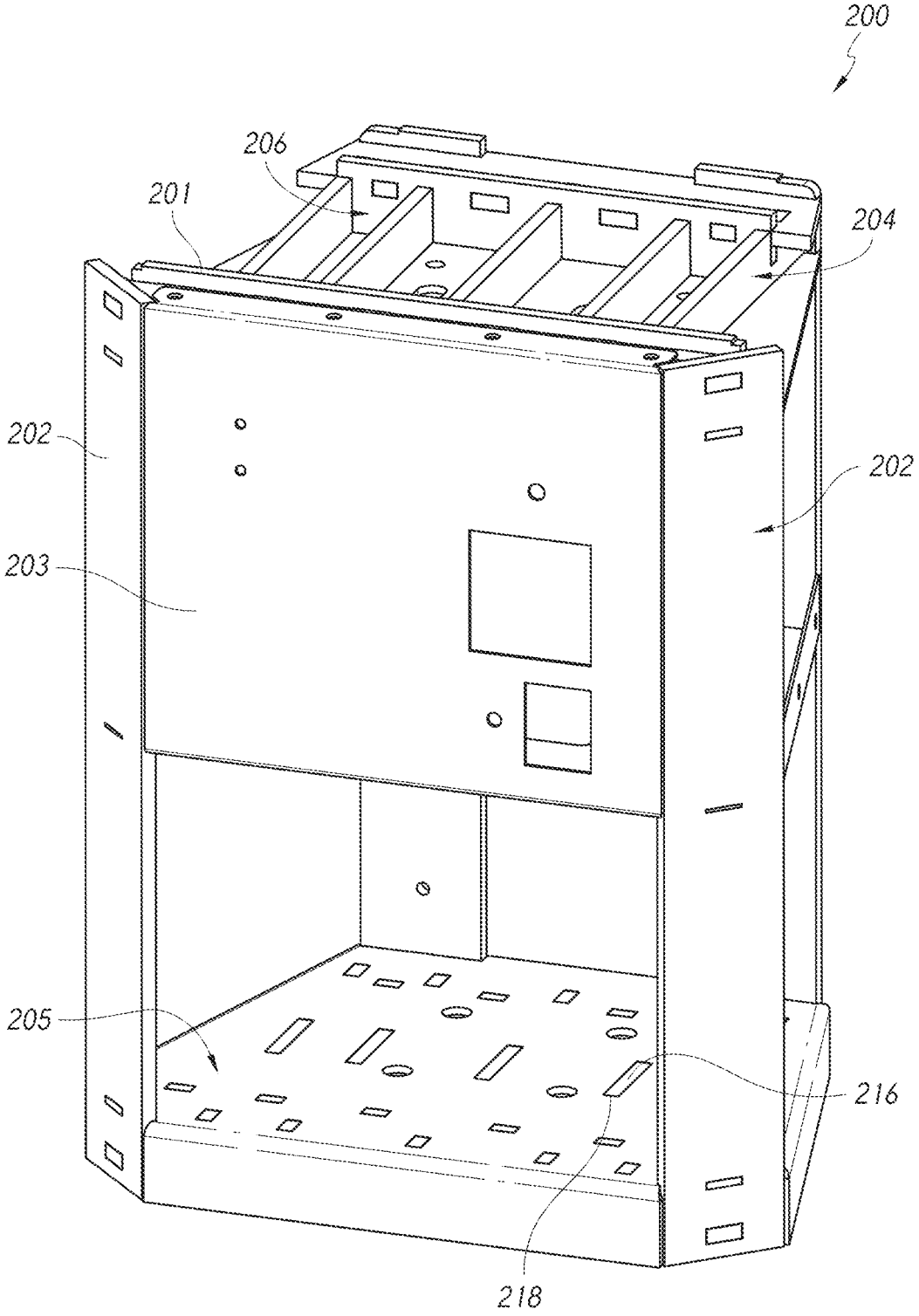
FIG. 6 illustrates a front perspective view of an embodiment of a frame assembly, which can be used with the press assembly of FIG. 1 or otherwise.
Figure 7:
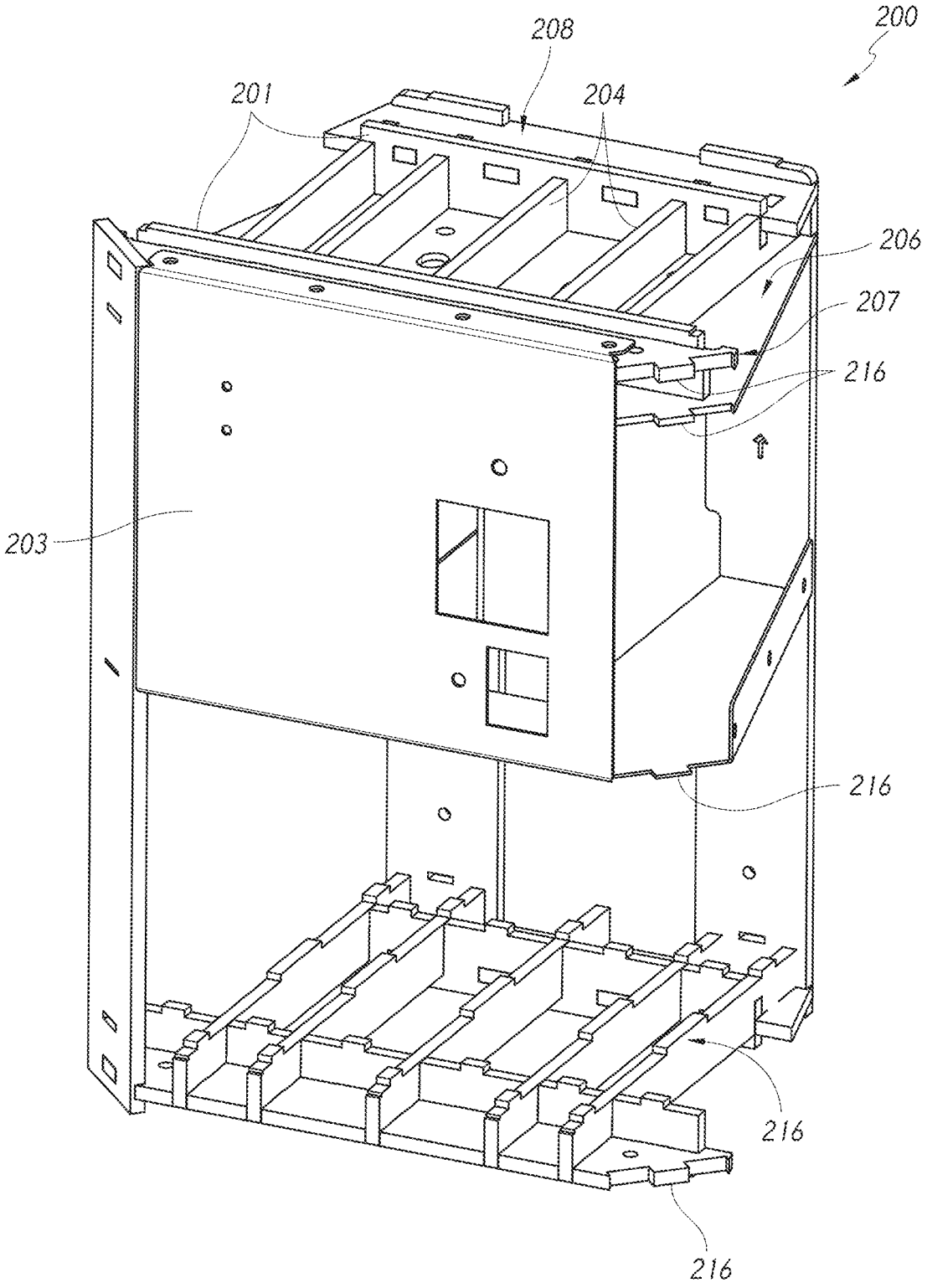
FIG. 7 illustrates a front perspective view of the frame assembly of FIG. 6 with a side plate removed for purposes of presentation.
Figure 8:
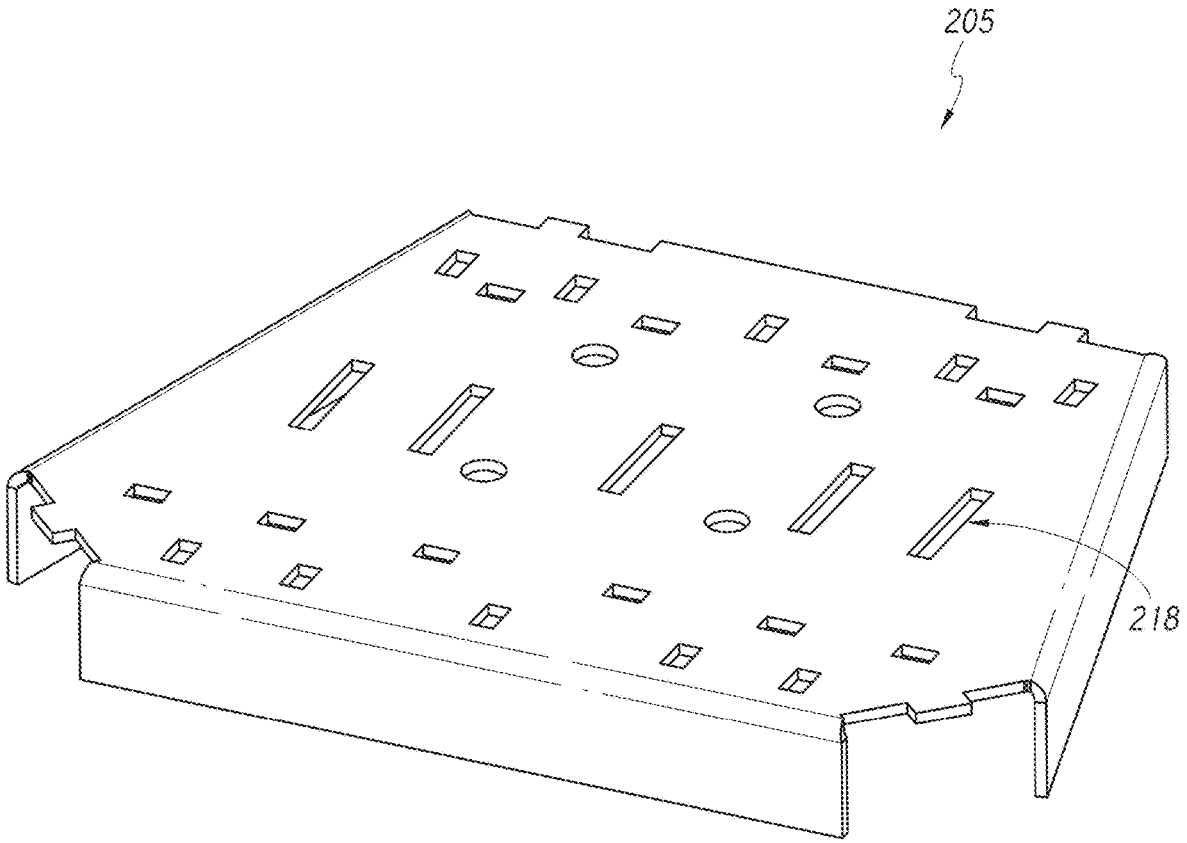
FIG. 8 illustrates a perspective view of a base plate of the frame assembly of FIG. 6.

FIGS. 6-8 illustrate another example of a frame 200, which can be used in place of a frame 110. The frame 200 can include an end plate 201, a side plate 202, a support plate 203, a cross plate 204, a base plate 205, an upper plate 206, a front plate 207, and a rear plate 208. In some embodiments, the frame 200 can include additional plates. The plates 201, 202, 203, 204, 205, 206, 207, and 208 can connect to form a three-dimensional structure. This structure can have an end that is narrower than the opposing end, resulting in a tapered shape, such as a generally U or V like shape. The plates 201, 202, 203, 204, 205, 206, 207, and 208 can be detachably connected, such as with fasteners, or permanently connected, such as with welds, or a combination of both. The plates 201, 202, 203, 204, and 205 can be made from metal sheet or plate, such as steel. The end plates 201 can be positioned at the base or top of the frame 200. The side plates 202 can extend generally vertically along the y-axis or sides of the frame 200. One or more cross plates 204 can extend generally horizontally along the x-axis of the frame 200 or along the z-axis of the frame 200. One or more base plates 205 can extend generally horizontally along the x-axis and z-axis of the frame 200. The support plate 203 can extend along the y-axis and z-axis of the frame 200. One or more upper plates 206 can extend generally horizontally along the x-axis and z-axis of the frame 200. One or more front plates 207 can extend generally horizontally along the x-axis and z-axis of the frame 200 near the front of the frame 200. One or more upper plates 208 can extend generally horizontally along the x-axis and z-axis of the frame 200 near the rear of the frame 200. Each plate 201, 202, 203, 204, 205, 206, 207, and 208 can be connected to one or more of the end plates 201, the side plates 202, the support plates 203, the cross plates 204, base plates 205, upper plate 206, front plate 207, and rear plate 208.

The end plates 201, side plates 202, support plates 203, cross plates 204, base plates 205, upper plates 206, front plates 207, and rear plates 208 can be interlocked with each other. The plates 201, 202, 203, 204, 205, 206, 207, and 208 can have tabs 216 and slots 218 formed into the plates. The tabs 216 can function in the same manner as tabs 116. The slots 218 can function in the same manner as slots 118. Thus, the slots 216 can mate with other tabs 218 or with slots 218 to form an interlocking structure. The frame 200 can have an interlocking structure near the top of the frame 200, near the bottom of the frame 200, near the middle of the frame 200, or at multiple locations along the frame 200.

Figure 9:
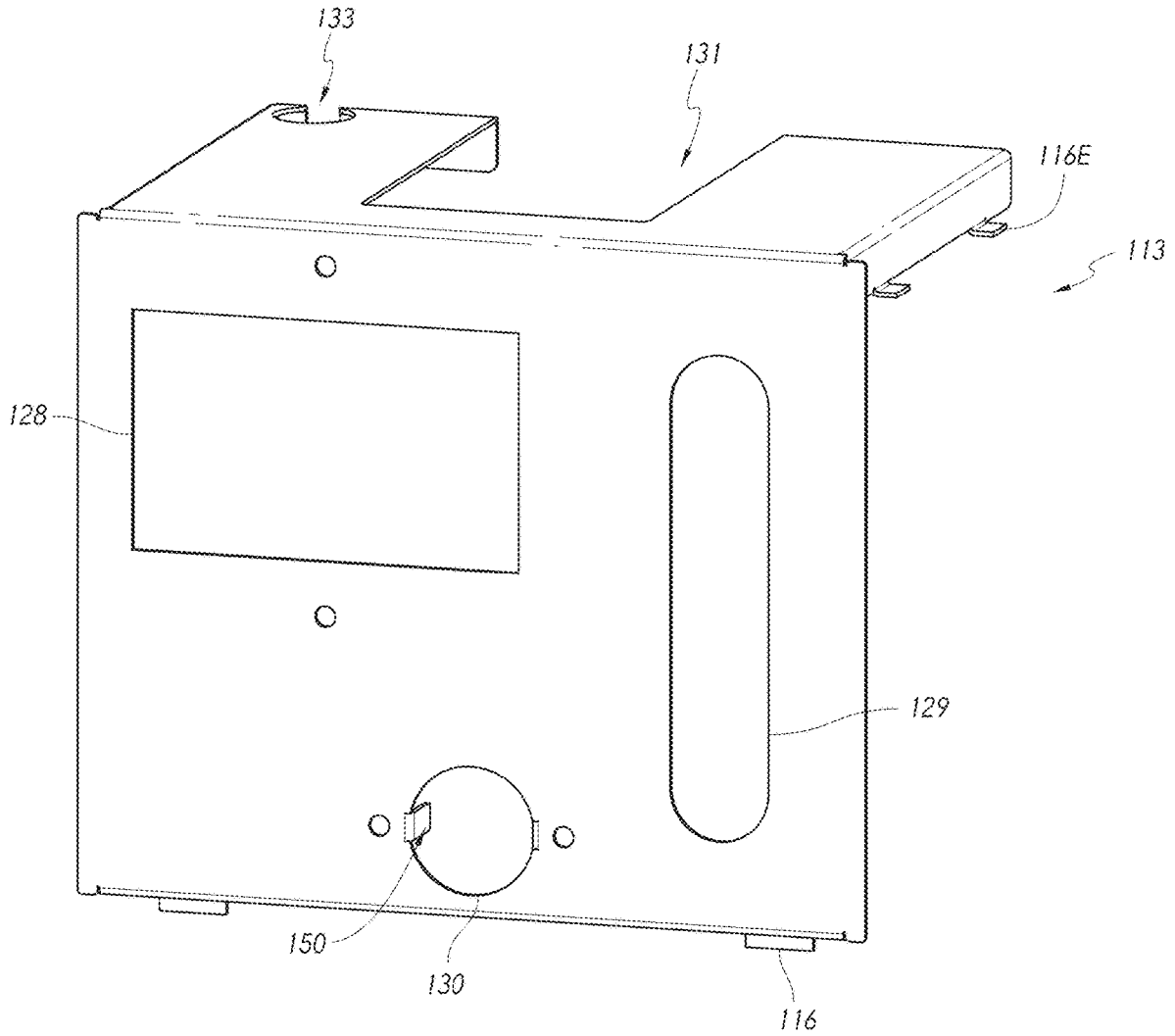
FIG. 9 illustrates a perspective view of a support plate of the frame assembly of FIG. 3.

FIG. 9 illustrates the support plate 113. As shown, the support plate 113 can include a generally vertical portion and a generally horizontal portion. The generally vertical portion can include a user interface area 128, such as a region to receive a touchscreen. The support plate 113 can include a handle aperture 129, which can receive the handle 144. The support plate 113 can have a release aperture 130, which can receive the release actuator 146. The release aperture 130 can include a flange 150. The generally horizontal portion of the support plate 113 can include an opening for passage of components of the press system 140. The support plate 113 can have generally downwardly extending tabs 116 that engage into corresponding slots in the base plate 115. In various embodiments, the support plate can include a routing aperture 133. The routing aperture 133 can be used to route cables (e.g. power cables, heating element wires, thermocouple cables, etc.) to the press plates 120.

Press System

Figure 10:
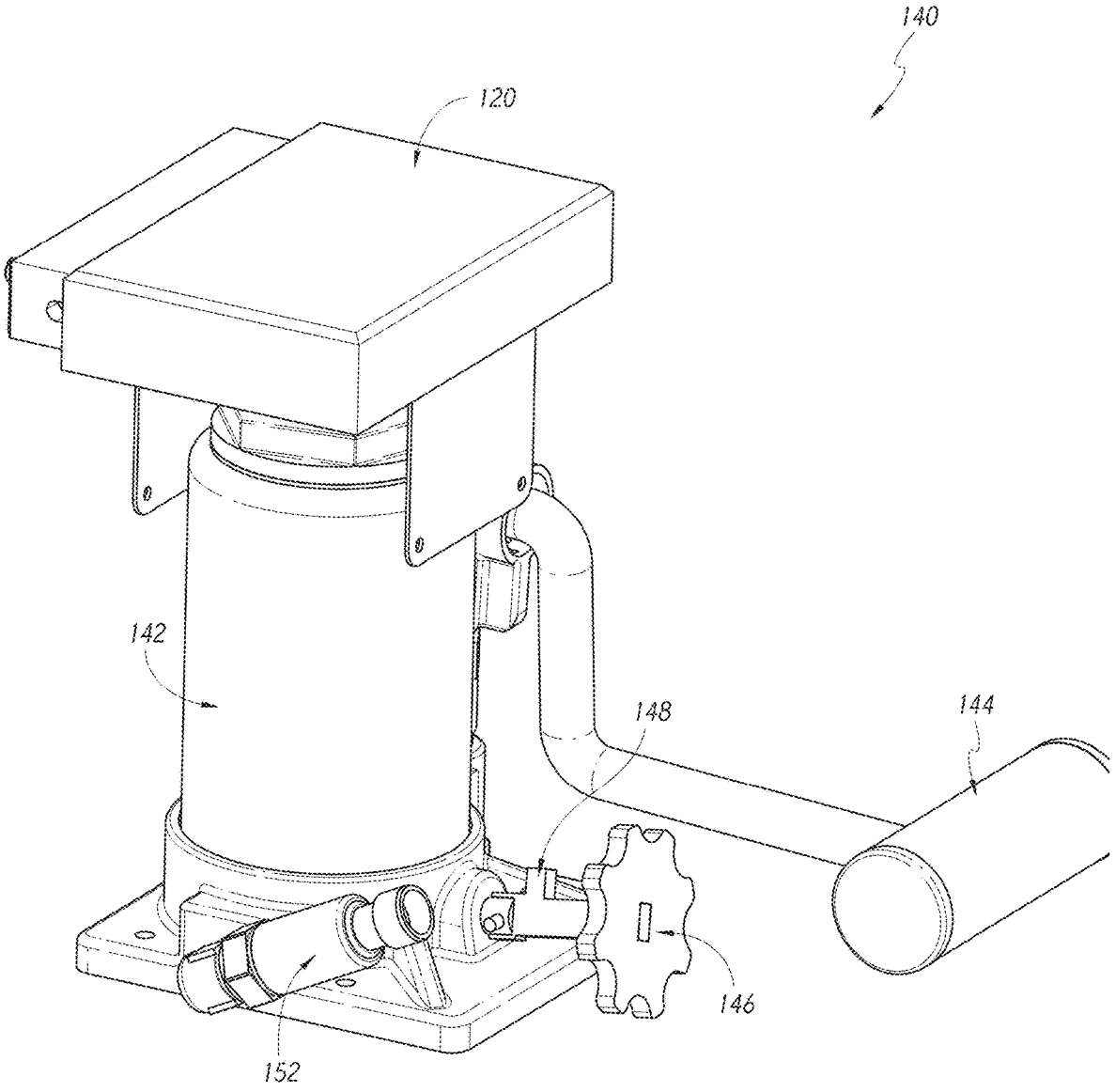
FIG. 10 illustrates a perspective view of a press system of the press assembly of FIG. 1.

FIG. 10 illustrates an example of the press system 140. The press system 140 can include a press 142, handle 144, and release actuator 146. The press 142 can be a hydraulic press. In some embodiments, the press 142 can be a pneumatic press, a screw press, or other mechanical press. The press 142 can be a bottle jack. The press 142 can be located on the base plate 115 of the frame 110 or another component of the frame 110. The handle 144 and release actuator 146 can be connected to the press 142. In some embodiments, the handle 144 can be used to increase pressure in the hydraulic fluid, resulting in the press 142 extending. In some variants, the handle 144 can be moved up and down by the user to actuate the press, thereby moving the plates 120 closer together and applying pressure to the material between the plates. In some variants, the plates 120 are moved by a motor, such as an electric motor. Various embodiments include a pressure sensor 152 configured to measure the pressure exerted on the hydraulic fluid within the press 142.

In various embodiments, the release handle 146 can be operated to release pressure on the hydraulic fluid, thereby causing the press 142 to retract. For example, the release handle 146 can be operated by being rotated and/or unscrewed. In some embodiments, the release actuator 146 comprises a threaded shaft and a stop tab 148. The stop tab 148 can inhibit or prevent the release handle 146 from being fully unscrewed and/or separated from the rest of the rosin press assembly 100, which would be inconvenient and could lead to the release actuator 146 being lost. The stop tab 148 can contact (e.g., abut against) the flange 150 formed on the support plate 113. This contact between the flange 150 and the stop tab 148 can prevent the release handle 146 from being further unscrewed, because the release handle 146 will stop rotating once the stop tab 148 contacts the flange 150.

The press system 140 can be used to apply pressure to plant material, such as *cannabis*. Increasing pressure of the press 142 by operating the handle 144 can cause the press 142 to extend. The extending press 142 will move the press plate 120 connected to the press 142 in the direction the press 142 is extending. The press 142 can move the first press plate 120 toward or into contact with the second press plate 120, thereby applying pressure to the plant material between the plates 120. The pressure within the press 142 can continue to be raised, which results in increased pressure being applied to the material between the press plates 120. The pressure sensor 152 can measure the pressure being exerted by the press 142 and output this data to a display, gauge, a CPU assembly 168, or another device.

The press system 140 can be automated. For example, the press system 140 can include a motor, which can be used to automatically increase and decrease pressure within the press system 140 without the need for an operator to manually adjust the handle 144 or release handle 146. As will be described in more detail below, an operator can interact with the user interface 130 to issue automated commands for the motor.

Control Unit

Figure 11:
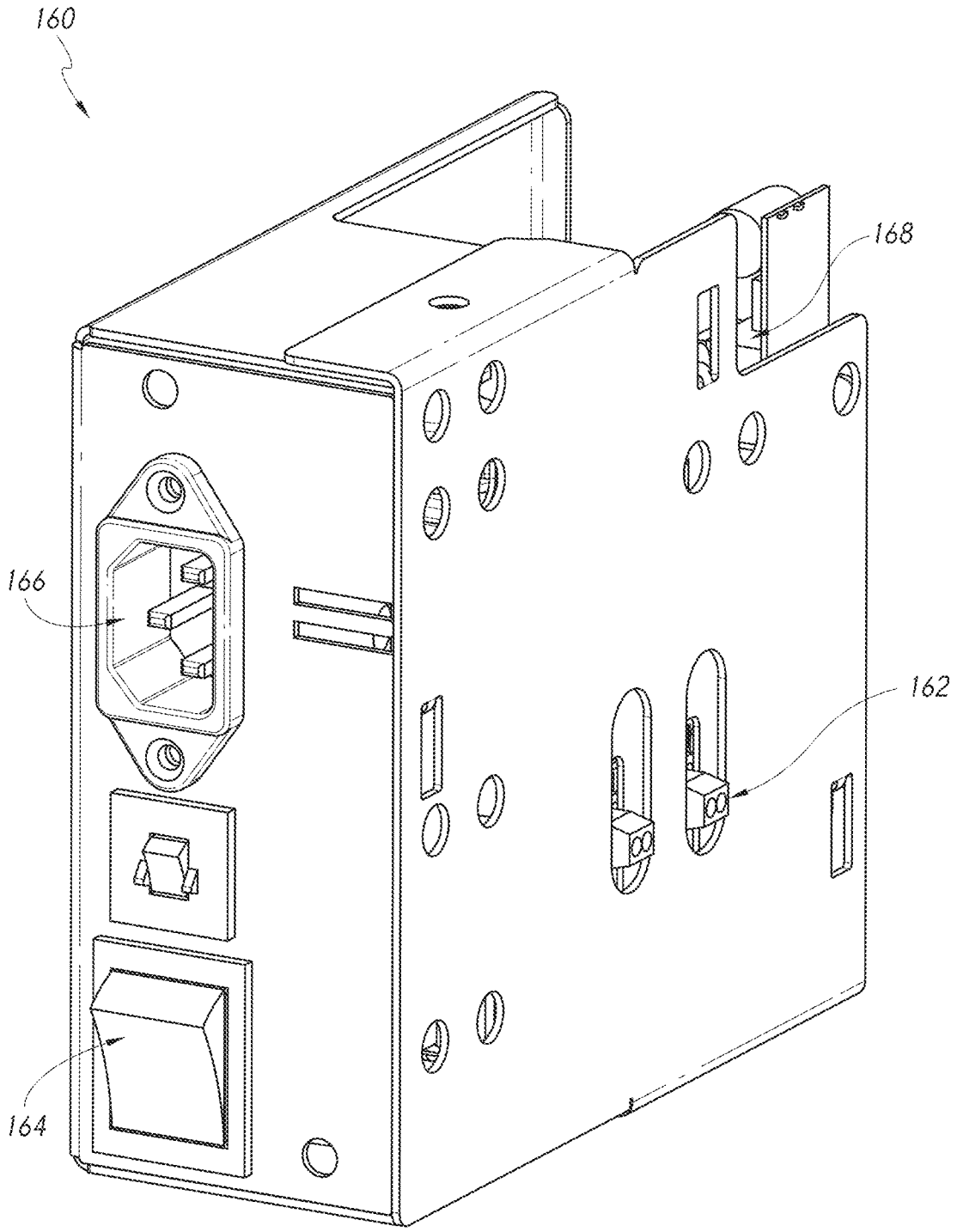
FIG. 11 illustrates a perspective view of a control unit of the press assembly of FIG. 1.

FIG. 11 illustrates a control unit 160. The control unit 160 can control and provide electric power to other components of the rosin press assembly 100. The control unit 160 can include a sensor connection 162, a power switch 164, a power connector 166, CPU assembly 168, and a frame 170. The frame 170 provides structural support for the other components of the control unit 160. The power switch 164 can be connected to the front of the frame 170 and can have its mechanical switch exposed. The power connector 166 can be connected to the front of the frame 170 and can be exposed for access. The CPU assembly 168 can be contained within the frame 170. The CPU assembly 168 can include, for example, an electronic processor and a non-transitory memory.

In several implementations, the sensor connection 162 can connect to a temperature sensor. The temperature sensor can be a thermocouple. The temperature sensor can be used to determine the temperature of the components of the rosin press assembly 100. In some embodiments, the temperature sensor can be used to determine the temperature of one or more of the press plates 120. The temperature sensor can be connected to one of the press plates 120, and can detect the temperature of the press plate 120. The detected temperature data can be outputted to the CPU assembly 168. In various embodiments, the assembly 100 contains two temperature sensors, such as two thermocouples 162. One thermocouple 162 can be used to measure the temperature of one press plate 120, while the other thermocouple can be used to measure the temperature of the other press plate 120. In some embodiments, a single temperature sensor (e.g., thermocouple) can be used to accurately measure the temperature of both press plates 120. For example, both press plates 120 can be pressed into contact with each other (e.g., abutted) and held for a period (e.g., at least about 1 minute), thereby reducing or eliminating any temperature variation between the plates 120 and allowing the single temperature sensor to measure the temperature of both press plates 120. Such use of a single temperature sensor can reduce cost, ease assembly, decrease the number of components that might fail or require maintenance, and/or simplify the electronics of the rosin press assembly 100.

The power switch 164 can be used to turn the electronics of the rosin press assembly 100 on or off. In some embodiments, the control unit 160 can contain additional power switches 164, which can be used to control the power of some subsystems of the rosin press assembly 100. For example, one power switch 164 can be used to control the power to the entire rosin press assembly 100, while a second power switch 164 can be used to control power to the user interface 130.

The power connector 166 can be used to connect the control unit 160 to an outside source of power, such as an electrical outlet. The outside source of power can be used to power the electronics of the rosin press assembly 100.

The CPU assembly 168 can be used to control the electrical components of the rosin press assembly 100. The CPU assembly 168 can contain a CPU and memory, which can be used to run programs and execute commands from the rosin press operator. These commands can be inputted into the system through the user interface 130. For example, the user interface 130 can be electrically connected to the CPU assembly 168. The user interface 130 can contain an input device, such as buttons, to enter commands and a screen to display information. In some embodiments, the user interface 130 can be a touch screen. By interacting with the user interface 130, a user can send commands to the CPU assembly 168 and have the CPU assembly 168 execute programs and/or send commands to components of the system. For example, an operator can send a command to the CPU assembly 168 to adjust the temperature of the press plates 120, which results in the CPU assembly 168 adjusting the heating element within the press plates 120. The CPU assembly 168 can be used to run programs and commands, such as to start a timer, turn on or off lights, operate the press, increase pressure, release pressure, start or stop a motor, perform calculations, etc. The CPU assembly 168 can also be used to display information to the operator. For example, the CPU assembly 168 can cause the user interface 130 to display the pressure information from the pressure sensor 152. The CPU assembly 168 can cause the user interface 130 to display other information, such as the time, a timer, results of a calculation, the temperature of the system, recommended pressures, recommended temperatures, recommended durations, and other information relating to the rosin press assembly 100. The CPU assembly 168 can be used for downloading files and programs from the internet, or for searching for information on the internet. The CPU assembly 168 can contain an Ethernet port, Bluetooth, Wi-Fi, or other features to connect to the internet or a separate device. The CPU assembly 168 can also contain a USB port to download files from a USB compatible drive or computer.

Operation

The rosin press assembly 100 can extract rosin from plant material, such as *cannabis*. The rosin press assembly 100 can extract rosin from *cannabis* by pressing *cannabis* plant material between two heated press plates 120. The press plates 120 can be pressed together by the press system 140. The press system 140 can move one or both of the press plates 120, and can cause both plates 120 to contact each other. For example, the press system 140 can move the first press plate 120 that is connected to the press 142 upwards to contact the second press plate 120 that is fixed the frame 110. The press system 140 can increase or decrease the pressure applied by the press plates 120 when the press plates 120 are pressed together.

The press plates 120 can be heated by a heating element, such as an electrical heating element. The heating element can comprise a wire that runs through the press plate 120. The heat generated by the wire can disperse into the press plate 120 and create a substantially uniform temperature within the press plate 120. In a variety of embodiments, the rosin press assembly 100 can use the temperature sensor (e.g., thermocouple) to measure the temperature of the press plates 120 and can adjust the heat output of the heating element to accommodate a range of temperatures.

*Cannabis* plant material can be placed on a press plate 120 directly or indirectly. For example, the *cannabis* plant material can be placed within a bag that is placed on the press plate 120, or can be placed on a parchment paper that is placed on the press plate 120. With the *cannabis* plant material placed on a press plate 120, the press system 140 can press the heated press plates 120 together to begin the rosin extraction process.

The rosin press assembly 100 can apply a variety of pressures and temperatures to *cannabis* plant material. In some embodiments, the rosin press assembly 100 can apply specific press methods. In some press methods, a required gauge pressure of the press 142 can be calculated and applied to the *cannabis* plant material. The pressure applied to the *cannabis* plant material can be calculated by determining the size (e.g., surface area) of *cannabis* plant material, the size (e.g., surface area) of the hydraulic ram within the press 142, and the size of the force exerted by the press 142.

In some implementations, to assist with determining the size of the *cannabis* plant material, the *cannabis* plant material can be placed within a bag. The bag can be a mesh bag, which can be used to help separate the rosin from the *cannabis* plant material by filtering the rosin from the *cannabis* plant material when the appropriate pressure and temperature is applied to the *cannabis* plant material. The bag can be folded into a cylindrical shape of a known diameter, allowing for easy determination of the volume and/or surface area of *cannabis* plant material being pressed. The surface area of the bag and/or press plate 120 can be determined, such as using a ruler or tape measure. The force exerted by the press can be measured by the pressure sensor 152. With this information, the amount of force applied to the *cannabis* plant material can be calculated.

In some embodiments, the rosin press assembly 100 can contain a calculator to assist with calculating the force applied to the *cannabis* material. An operator can interact with the calculator by interacting with the user interface. In various embodiments, the CPU assembly 168 can store recommended pressures, temperatures, and durations for different varieties and sizes of *cannabis*. This stored information can be recalled by the operator and can be displayed or outputted to the user interface 130. In various embodiments, the calculator can store information about the rosin press assembly 100 (e.g. the surface area of the press plate 120) and can require that a user enter in information about the variety of *cannabis*, the weight of *cannabis* plant material, the size of the bags holding the *cannabis* plant material, and the number of bags used. The calculator can use this information to determine a recommended pressure, temperature, and duration for the particular situation, and display that information to the operator. In some embodiments, after the user has entered in the information about the variety of *cannabis*, the weight of *cannabis* plant material, and the size of the bags holding the *cannabis* plant material, the rosin press assembly 100 can automatically apply the recommended pressure and temperature to the *cannabis* plant material for the recommended duration.

An example method of use of the rosin press assembly will now be described. The operator can power on the rosin press assembly 100 by connecting power to the rosin press assembly 100 through the power connector 166 and switching the power switch 164 to on. The operator can prepare the *cannabis* material by weighing the *cannabis* material, placing the *cannabis* material in bags, and folding the bags (e.g., to form a generally cylindrical shape).

The operator can interact with the user interface 130 and enter in information about the *cannabis*, including the variety of *cannabis*, the weight of *cannabis*, the size of bags, and the number of bags used, etc. With this information, the CPU assembly 168 can determine a recommended pressure to apply to the *cannabis*, the recommended temperature of the press plates 120, and the duration that pressure and temperature should be applied to the *cannabis* material. The CPU assembly 168 can output this determined information to the user interface 130 to display to the operator.

The operator can prepare the rosin press assembly 100 for rosin extraction. For example, the operator can interact with the user interface 130 to turn on the heating element within the press plates 120. With the heating element on, the operator can use the press 142 to press the press plates 120 together, so the temperature of the press plates 120 will be equalized. The temperature sensor can measure the temperature of the press plates 120 and display the temperature on the user interface 130. In some embodiments, the plates 120 are held together for a period (e.g., at least about: 30 seconds, 1 minutes, 2 minutes, etc.) or until a recommended temperature is reached. The operator can separate the press plates 120.

The user can place a collection material, such as parchment paper, on the press plates 120. The operator can place the folded bags of *cannabis* plant material on the collection material. The operator can press the bags between the press plates 120 at the recommended pressure. The operator can increase pressure in the press 142 by using the handle 144, such as by pumping or depressing the handle 144. The operator can continue to increase the pressure until the pressure measured by the pressure sensor 152 reaches the recommended pressure. In some implementations, the operator can interact with the user interface 130 to start a timer. After a period (e.g., the timer has elapsed), the operator can release pressure by turning or otherwise actuating the release handle 146. The release of pressure can cause the plates 120 to separate or the user can separate the plates 120. The operator can remove the pressed *cannabis* material and collect the expelled rosin.

Additional Press Assemblies

Figure 12:
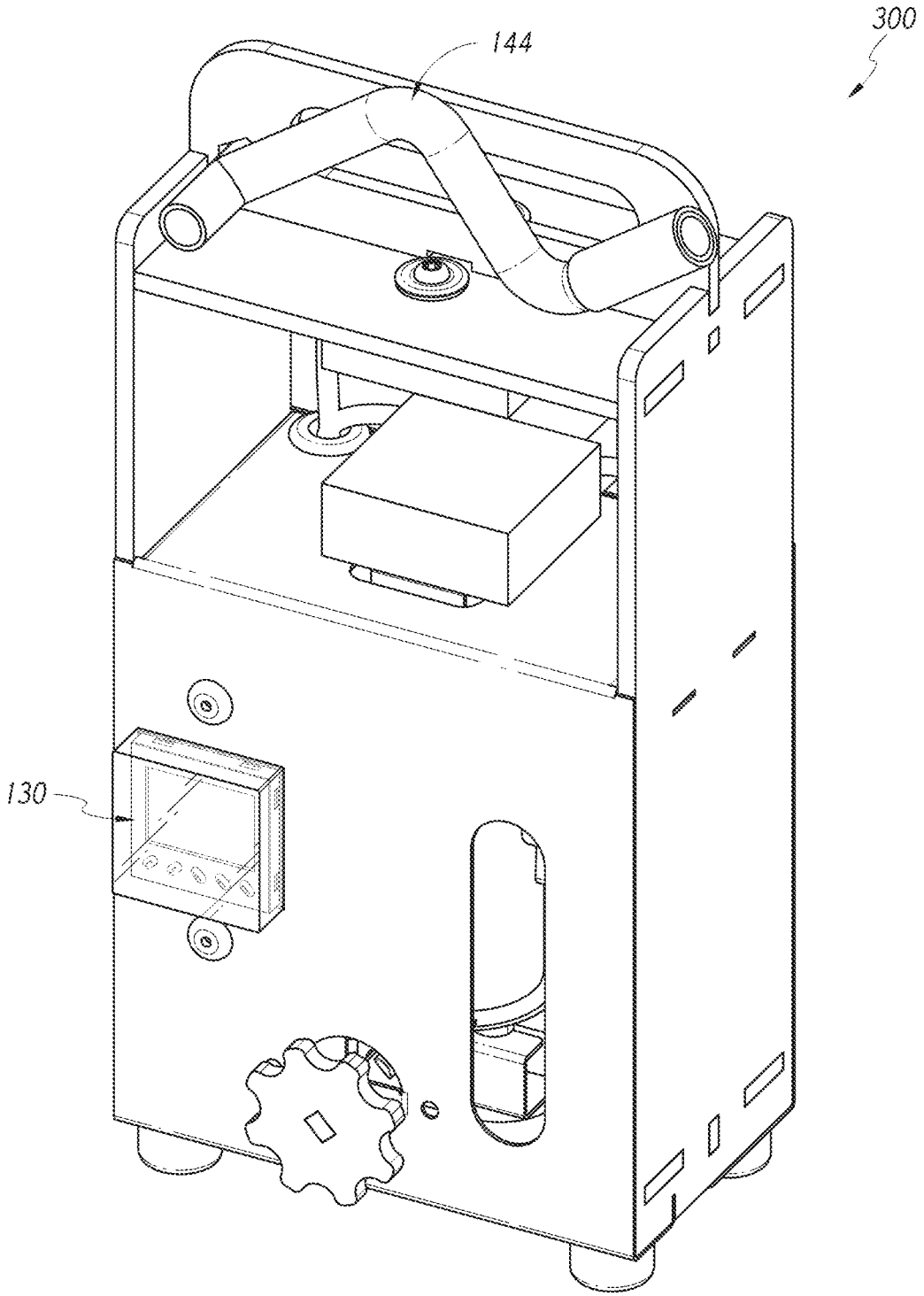
FIG. 12 illustrates a front perspective view of another embodiment of a press assembly.

FIG. 12 illustrates another rosin press assembly 300. The rosin press assembly 300 can contain any of the parts of any of the rosin press assemblies 100, 200 and can function in a similar manner as any of the rosin press assemblies 100, 200. The rosin press assembly 300 can be smaller than the rosin press assembly 100. In some embodiments, the rosin press assembly 300 does not include any tabs 116 connecting, or interdigitating, with tabs 116 from other parts of the frame 110. Instead, the tabs 116 connect to, or interlock with, the slots 118. In various embodiments, the handle 144 can be detachable from the rosin press assembly 300. As shown, the assembly 300 can include an upper chamber that receives the handle 144 in the removed state. This can enhance portability. In some embodiments, the user interface 130 can include a removable cover.

Figure 13:
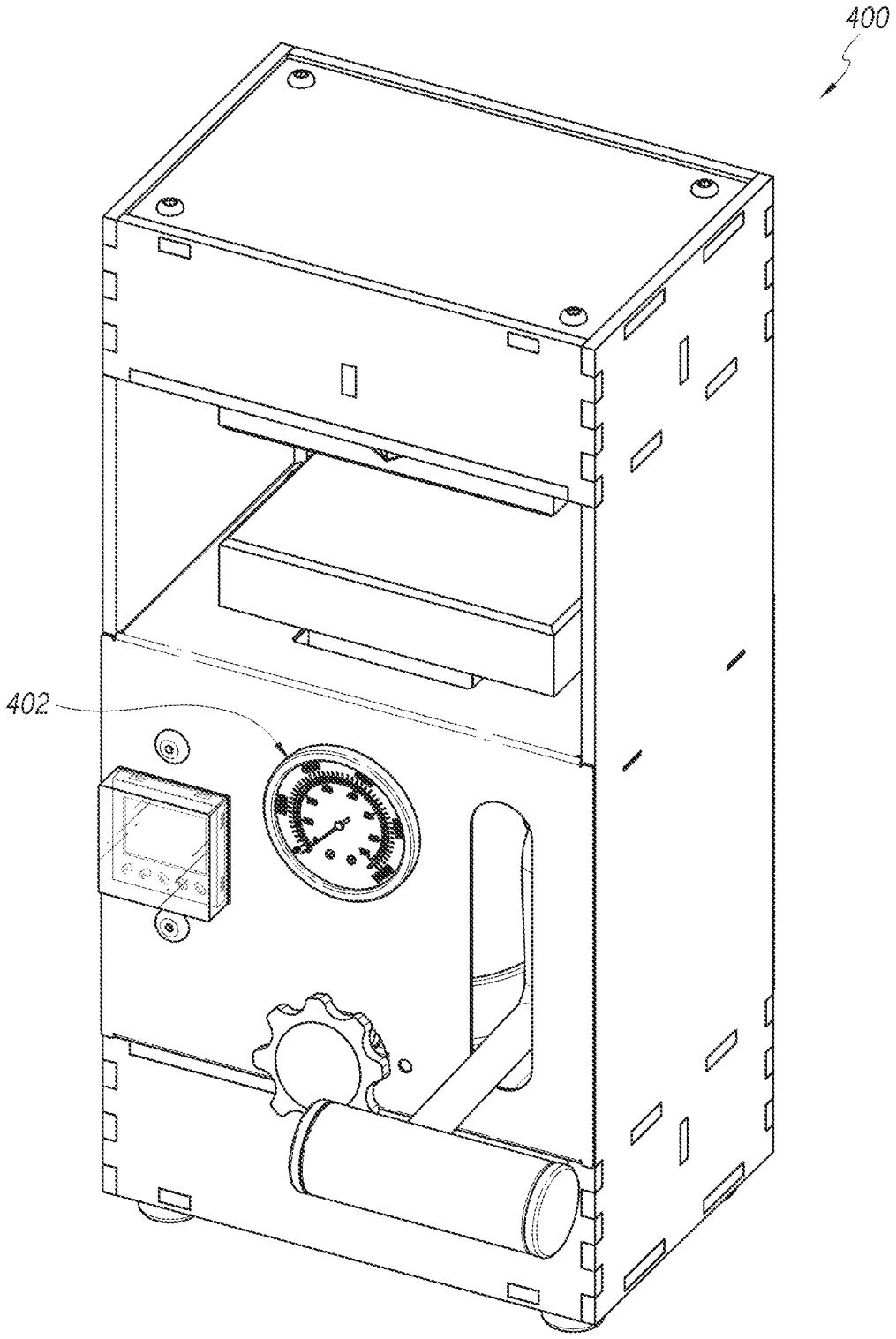
FIG. 13 illustrates a front perspective view of another embodiment of a press assembly.

FIG. 13 illustrates another rosin press assembly 400. The rosin press assembly 400 can contain any of the parts of any of the rosin press assemblies 100-300 and can function in a similar manner as any of the rosin press assemblies 100-300. The rosin press assembly 400 can include a gauge 402. The gauge 402 can display the pressure output from the pressure sensor 152.

Figure 14:
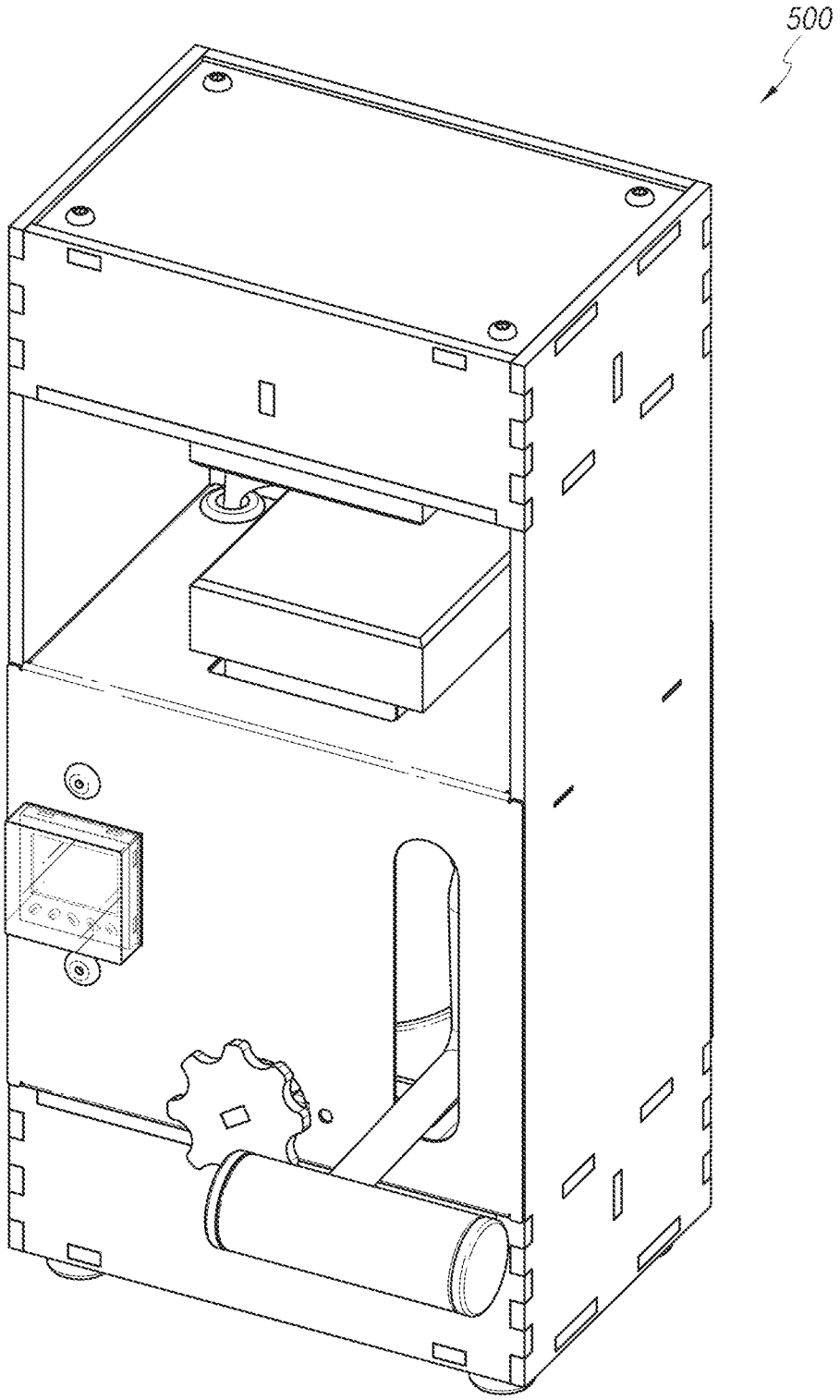
FIG. 14 illustrates a front perspective view of another embodiment of a press assembly.

FIG. 14 illustrates another rosin press assembly 500. The rosin press assembly 500 can contain any of the parts of any of the rosin press assemblies 100-400 and can function in a similar manner as any of the rosin press assemblies 100-400. The rosin press assembly 500 can include a smaller user interface 130 than the rosin press assembly 100.

Figure 15:
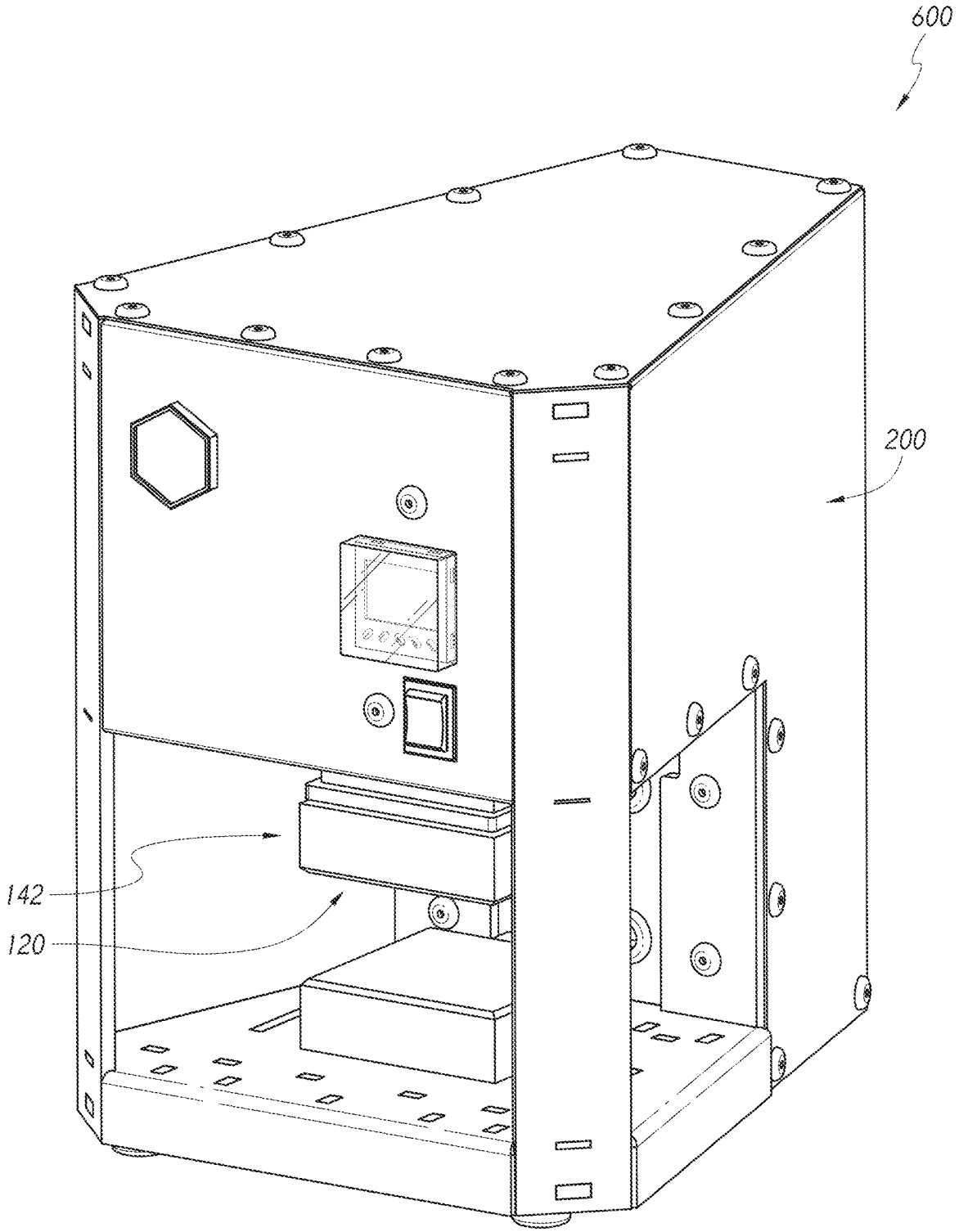
FIG. 15 illustrates a front perspective view of another embodiment of a press assembly.

FIG. 15 illustrates another rosin press assembly 600. The rosin press assembly 600 can contain any of the parts of any of the rosin press assemblies 100-500 and can function in a similar manner as any of the rosin press assemblies 100-500.

For example, the rosin press assembly 600 can have the frame 200. The assembly 600 can have a press 142 that is oriented and/or moves downwards, so that the press plate 120 connected to the press 142 extends downwards towards the second press plate 120.

Figure 16:
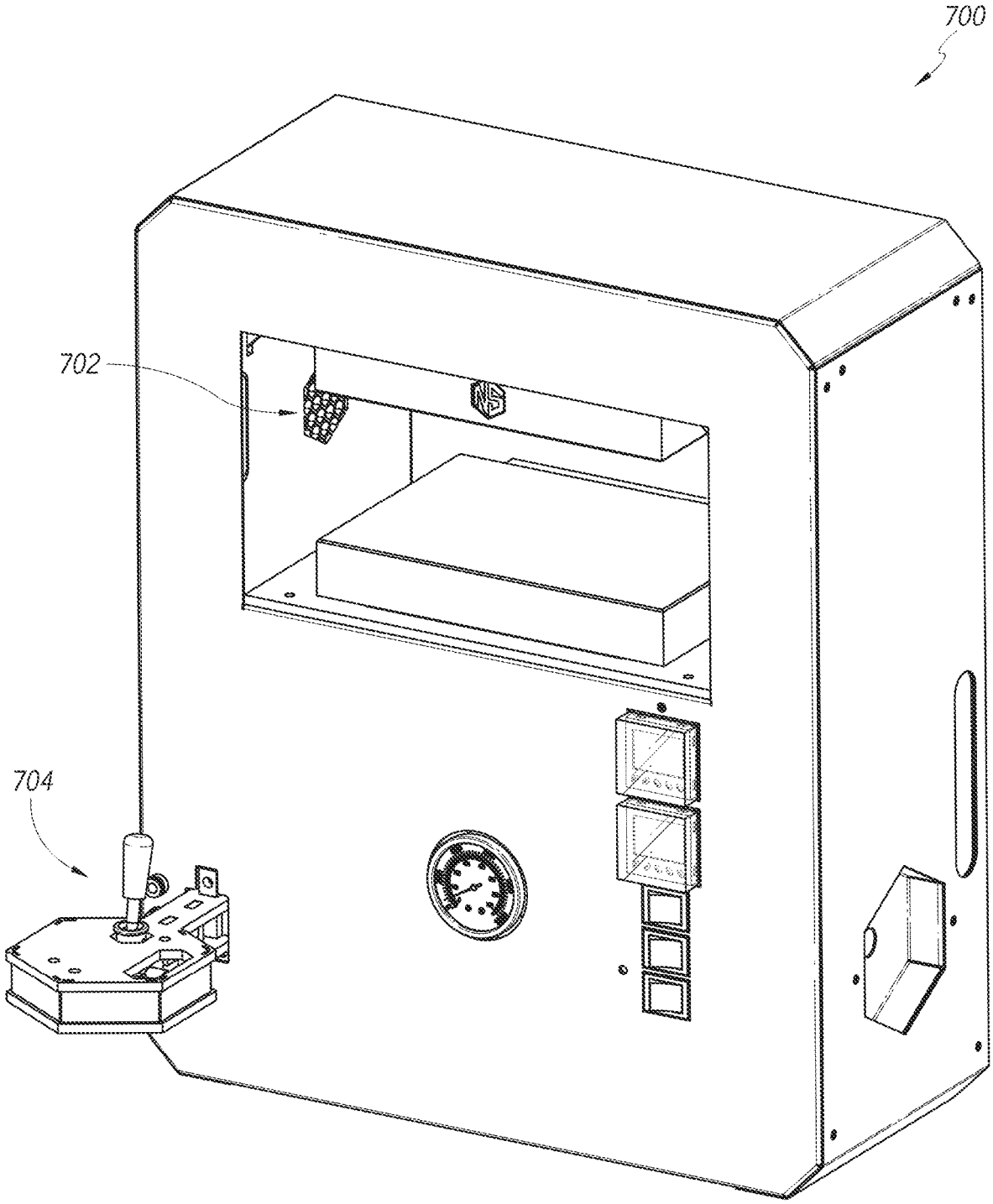
FIG. 16 illustrates a front perspective view of another embodiment of a press assembly.

FIG. 16 illustrates a rosin press assembly 700. The rosin press assembly 700 can contain any of the parts of any of the rosin press assemblies 100-600 and can function in a similar manner as any of the rosin press assemblies 100-600. The rosin press assembly 700 can include a lighting assembly 702. The light assembly 702 can contain one or more LEDs or other light sources, which can be used to illuminate the press plates 120. The rosin press assembly 700 can include an actuator 704 (e.g., a joystick), which can be used to increase and decrease pressure of the press 142.

Certain Terminology

Terms of orientation used herein, such as "top," "bottom," "upper," "lower," "horizontal," "vertical," "longitudinal," "lateral," and "end" are used in the context of the illustrated embodiments. These terms are to be understood in the context and orientation of how the rosin press assemblies are intended to be operated. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular" or "cylindrical" or "semi-circular" or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

The terms "approximately," "about," and "substantially" as used herein represent an amount close to the stated amount that still performs a desired function or achieves a desired result. For example, in some embodiments, as the context may dictate, the terms "approximately", "about", and "substantially" may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may dictate, the term "generally parallel" can refer to something that departs from exactly parallel by less than or equal to 20 degrees and the term "generally perpendicular" can refer to something that departs from exactly perpendicular by less than or equal to 20 degrees.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B, and C" can include a first processor configured to carry out recitation A working in conjunction with a second processor configured to carry out recitations B and C.

The terms "comprising," "including," "having," and the like are synonymous and are used inclusively, in an open-ended fashion, and do not exclude additional elements, features, acts, operations, and so forth. Likewise, the terms "some," "certain," and the like are synonymous and are used in an open-ended fashion. Also, the term "or" is used in its inclusive sense (and not in its exclusive sense) so that when used, for example, to connect a list of elements, the term "or" means one, some, or all of the elements in the list.

Overall, the language of the claims is to be interpreted broadly based on the language employed in the claims. The language of the claims is not to be limited to the non-exclusive embodiments and examples that are illustrated and described in this disclosure, or that are discussed during the prosecution of the application.

Summary

The technology of the present disclosure has been discussed in the context of certain embodiments and examples. The technology extends beyond the specifically disclosed embodiments to other alternative embodiments and/or uses of the embodiments and certain modifications and equivalents thereof. For example, although certain embodiments are disclosed in the context of a manually-operated press assembly, the technology can be applied to motorized presses too. Additionally, although certain embodiments have been disclosed with tabs on certain plates and slots on other plates, the configurations can be reversed so that the slot is on the certain plates and tabs are on the other plates. Any two or more of the components can be made from a single monolithic piece or from separate pieces connected together. Various features and aspects of the disclosed embodiments can be combined with or substituted for one another in order to form varying modes of the invention. The scope of this disclosure should not be limited by the particular disclosed embodiments described herein.

Certain features that are described in this disclosure in the context of separate implementations can also be implemented in combination in a single implementation. Conversely, various features that are described in the context of a single implementation can also be implemented in multiple implementations separately or in any suitable subcombination. Although features may be described above as acting in certain combinations, one or more features from a claimed combination can, in some cases, be excised from the combination, and the combination may be claimed as any subcombination or variation of any subcombination.

Moreover, while operations may be depicted in the drawings or described in the specification in a particular order, such operations need not be performed in the particular order shown or in sequential order, and all operations need not be performed, to achieve the desirable results. Other operations that are not depicted or described can be incorporated in the example methods and processes. For example, one or more additional operations can be performed before, after, simultaneously, or between any of the described operations. Further, the operations may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Some embodiments have been described in connection with the accompanying drawings. The figures are drawn to scale, but such scale is not limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, any methods described herein may be practiced using any device suitable for performing the recited steps.

In summary, various embodiments and examples of dispensing systems and related methods have been disclosed. Although the dispensing systems have been disclosed in the context of those embodiments and examples, the technology of this disclosure extends beyond the specifically disclosed embodiments to other alternative embodiments and/or other uses of the embodiments, as well as to certain modifications and equivalents thereof. This disclosure expressly contemplates that various features and aspects of the disclosed embodiments can be combined with, or substituted for, one another. Thus, the scope of this disclosure should not be limited by the particular disclosed embodiments described above, but should be determined only by a fair reading of the claims that follow.

The following is claimed:

1. A rosin press apparatus configured to extract rosin from a plant material, the apparatus comprising:

a frame having a first side plate, a second side plate, a top end support box, a bottom end support box, and a support plate located between the top and bottom end support boxes, wherein the top end support box comprises a first cross plate and a second cross plate, the first and second cross plates being interdigitated with the first and second side plates at top corners of the frame, an intermediate plate positioned between the first and second cross plates, a transverse plate positioned between the first and second side plates, an upper plate positioned below the transverse plate and the intermediate plate, and an addition plate positioned above the upper plate, and wherein the bottom end support box comprises a third cross plate and a fourth cross plate, the third and fourth cross plates being interdigitated with the first and second side plates at bottom corners of the frame, an intermediate plate positioned between the third and fourth cross plates, a transverse plate positioned between the first and second side plates, a base plate positioned above the transverse plate and the intermediate plate, and an additional plate positioned below the base plate;

a hydraulic press connected to the frame;

a first press plate connected to the press;

a second press plate connected to an underside of the upper plate of the top end support box of the frame and oriented above the first press plate; and a heating element configured to heat at least one of the first and second press plates;

the press being configured to drive the first press plate toward the second press plate, thereby applying pressure to the plant material positioned between the first and second press plates and wherein the frame is configured to inhibit flexing during such application of pressure.

2. The rosin press apparatus of claim 1, wherein the first side plate comprises a first plurality of tabs and the second cross plate comprises a second plurality of tabs, the first and second plurality of tabs being interdigitated at a first corner of the frame.

3. The rosin press apparatus of claim 2, wherein the first plurality of tabs is configured to form a friction fit with the second plurality of tabs.

4. The rosin press apparatus of claim 1, wherein the first side plate and the first cross plate being interdigitated at a topmost corner of the frame.

5. The rosin press apparatus of claim 1, wherein the first side plate comprises a slot, the slot being sized to tightly fit a first tab from the upper plate.

6. The rosin press apparatus of claim 5, wherein the slot is oriented generally horizontally.

7. The rosin press apparatus of claim 5, wherein the second side plate comprises a slot, the slot being sized to receive a second tab from the upper plate.

8. The rosin press apparatus of claim 1, wherein the frame forms an interdigitated structure at each corner of the frame.

9. The rosin press apparatus of claim 1, further comprising a handle configured to increase pressure in the press.

10. The rosin press apparatus of claim 1, wherein the heating element is configured to heat the first press plate, and further comprising a second heating element that is configured to heat the second press plate.

11. The rosin press apparatus of claim 1, wherein the first press plate is electrically connected to a thermocouple, the thermocouple being configured to measure the temperature of the first press plate.

12. The rosin press apparatus of claim 1, wherein the press comprises a bottle jack.

13. The rosin press apparatus of claim 1, further comprising a user interface, the user interface configured to receive inputs and display information.

14. A combination comprising:

a plant material; and a rosin press apparatus configured to extract rosin from a plant material, the apparatus comprising:

a frame having a first side plate, a second side plate, a top end support box, a bottom end support box, and a support plate located between the top and bottom end support boxes, wherein the top end support box comprises a first cross plate and a second cross plate, the first and second cross plates being interdigitated with the first and second side plates at top corners of the frame, an intermediate plate positioned between the first and second cross plates, a transverse plate positioned between the first and second side plates, an upper plate positioned below the transverse plate and the intermediate plate, and an addition plate positioned above the upper plate, and wherein the bottom end support box comprises a third cross plate and a fourth cross plate, the third and fourth cross plates being interdigitated with the first and second side plates at bottom corners of the frame, an intermediate plate positioned between the third and fourth cross plates, a transverse plate positioned between the first and second side plates, a base plate positioned above the transverse plate and the intermediate plate, and an additional plate positioned below the base plate;

a press connected to the frame;

a first press plate connected to the press;

a second press plate connected to an underside of the upper plate of the top end support box of the frame and oriented above the first press plate; and a heating element configured to heat at least one of the first and second press plates;

the press being configured to drive the first press plate toward the second press plate, thereby applying pressure to the plant material positioned between the first and second press plates and wherein the frame is configured to inhibit flexing during such application of pressure.

15. A rosin press apparatus configured to extract rosin from a plant material, the apparatus comprising:

a frame comprising a first plate and a second plate, the first and second plates being interdigitated at a corner of the frame;

a hydraulic press connected to the frame;

a release actuator comprising a stop tab and configured to release pressure from the press;

a support plate comprising a flange configured to contact the stop tab;

a first press plate connected to the press;

a second press plate connected to the frame and oriented above the first press plate; and a heating element configured to heat at least one of the first and second press plates;

the press being configured to drive the first press plate toward the second press plate, thereby applying pressure to the plant material positioned between the first and second press plates.

16. A rosin press apparatus configured to extract rosin from a plant material, the apparatus comprising:

a frame comprising a first plate, a second plate, and a flange, the first and second plates being interdigitated at a corner of the frame;

a hydraulic press connected to the frame;

a release actuator configured to release pressure from the press, the release actuator comprising a stop, the release actuator configured to rotate the stop into abutment with the flange;

a first press plate connected to the press;

a second press plate connected to the frame and oriented above the first press plate; and a heating element configured to heat at least one of the first and second press plates;

the press being configured to drive the first press plate toward the second press plate, thereby applying pressure to the plant material positioned between the first and second press plates.

* * * * *